US009847600B2

(12) United States Patent
Yamada et al.

(10) Patent No.: US 9,847,600 B2
(45) Date of Patent: Dec. 19, 2017

(54) LEVER FITTING-TYPE CONNECTOR

(71) Applicant: YAZAKI CORPORATION, Tokyo (JP)

(72) Inventors: Go Yamada, Kakegawa (JP); Hiroshi Shinba, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/245,375

(22) Filed: Aug. 24, 2016

(65) Prior Publication Data

US 2016/0365672 A1 Dec. 15, 2016

Related U.S. Application Data

(63) Continuation of application No. PCT/JP2015/059805, filed on Mar. 27, 2015.

(30) Foreign Application Priority Data

Mar. 28, 2014 (JP) ..... 2014-067560

(51) Int. Cl.
*H01R 13/66* (2006.01)
*H01R 13/629* (2006.01)
*H01R 13/688* (2011.01)

(52) U.S. Cl.
CPC ..... *H01R 13/62933* (2013.01); *H01R 13/688* (2013.01); *H01R 2201/26* (2013.01)

(58) Field of Classification Search
CPC ..... H01R 2201/26; H01R 13/688; H01R 13/62933

(Continued)

(56) References Cited

U.S. PATENT DOCUMENTS 6,755,673 B2 * 6/2004 Fukushima ..... H01R 13/641 439/157
7,872,206 B2 * 1/2011 Matsunaga ..... H01H 9/085 200/335

(Continued)

FOREIGN PATENT DOCUMENTS

JP 2002-343169 A 11/2002
JP 2003-100385 A 4/2003

(Continued)

OTHER PUBLICATIONS

Communication dated Oct. 13, 2016 issued by the International Searching Authority in counterpart International Application No. PCT/JP2015/059805 (PCT/IB/338, PCT/IB/373 and PCT/ISA/237).

(Continued)

*Primary Examiner* — Abdullah Riyami
*Assistant Examiner* — Nelson R Burgos-Guntin
(74) *Attorney, Agent, or Firm* — Sughrue Mion, PLLC

(57) ABSTRACT

A lever fitting-type connector has a lever and a plug housing, the lever fitting-type connector includes: a contact member and a triangular recess in an inner wall surface of a sidewall of the lever and an outer wall surface of the plug housing. The triangular recess includes: a first inclined surface extending in a direction from the sliding start position toward the sliding end position and inclined in a projecting direction of the contact member; and a second inclined surface extending in a direction from the edge of the first inclined surface on the sliding end position side toward the sliding end position and inclined in a direction opposite to the projecting direction of the contact member. With a sliding direction of the lever as a reference, an inclined angle of the second inclined surface is smaller than an inclined angle of the first inclined surface.

6 Claims, 26 Drawing Sheets

(58) Field of Classification Search
USPC ..... 439/157, 620.34, 372, 924.1, 924.2
See application file for complete search history.

(56) References Cited

U.S. PATENT DOCUMENTS

| | | | | |
|---|---|---|---|---|
| 8,986,024 | B2 * | 3/2015 | Ikeda | H01H 9/102 200/332 |
| 8,992,239 | B2 | 3/2015 | Furuya et al. | |
| 9,171,685 | B2 * | 10/2015 | Henmi | H01H 35/003 |
| 9,293,289 | B2 * | 3/2016 | Chen | |
| 9,397,459 | B2 * | 7/2016 | Butcher | H01R 33/95 |
| 2002/0173185 | A1 | 11/2002 | Fukushima et al. | |
| 2005/0098419 | A1 * | 5/2005 | Matsui | H01R 13/62933 200/311 |
| 2008/0242150 | A1 * | 10/2008 | Chikamatsu | H01H 85/0208 439/620.3 |
| 2009/0047812 | A1 * | 2/2009 | Deno | H01R 13/748 439/157 |
| 2013/0017697 | A1 | 1/2013 | Furuya et al. | |
| 2013/0044784 | A1 | 2/2013 | Deckers et al. | |
| 2013/0237078 | A1 * | 9/2013 | Ikeda | H01H 9/102 439/157 |

FOREIGN PATENT DOCUMENTS

| | | | |
|---|---|---|---|
| JP | 2012-59554 | A | 3/2012 |
| WO | 2014/041095 | A1 | 3/2014 |

OTHER PUBLICATIONS

International Search Report dated Jun. 9, 2015 issued by International Searching Authority in counterpart International Application No. PCT/JP2015/059805 (PCT/ISA/210).

Written Opinion dated Jun. 9, 2015 issued by International Searching Authority in counterpart International Application No. PCT/JP2015/059805 (PCT/ISA/237).

* cited by examiner

LEVER FITTING-TYPE CONNECTOR

CROSS REFERENCE TO RELATED APPLICATIONS

This application is a continuation of PCT application No. PCT/JP15/059805, which was filed on Mar. 27, 2015 based on Japanese Patent Application (No. 2014-067560) filed on Mar. 28, 2014, the contents of which are incorporated herein by reference.

BACKGROUND OF THE INVENTION

1. Field of the Invention

The present invention relates to a lever fitting-type connector, particularly to a configuration in which midway-insertion of a signal terminal disposed in a lever section of the lever fitting-type connector is prevented.

2. Description of the Related Art

In a vehicle such as an electric automobile, hybrid car, or the like, in which a high-voltage high-power battery is mounted, in order to secure an operator's safety, a power circuit cutoff device is mounted such that the battery is assembled to a vehicle or a maintenance operation is performed in a state in which a power circuit is manually cut off in order to secure the operator's safety. The power circuit cutoff device is configured to include, for example, a lever fitting-type connector in which a lever for operating insertion into and removal from a plug housing that is provided with an electrode (fixing electrode) is disposed, and a vehicle-side connector in which the lever fitting-type connector is fitted. The lever fitting-type connector employs a configuration in which a pair of electrodes (male electrodes) and a fuse disposed between the pair of electrodes are provided in the plug housing, and a lever cylinder provided with a signal terminal is disposed on a side of the lever. In comparison, the vehicle-side connector includes a vehicle-side housing in which electrodes (female electrodes), in which the pair of electrodes (male electrodes) of the lever fitting-type connector are fitted, respectively, are disposed, and a fitting-detecting female connector formed to project from the vehicle-side housing. In such a configuration, horizontal movement of the lever allows the signal terminal in the lever cylinder to be fitted in the female electrodes in the fitting-detecting female connector.

As the power circuit cutoff device employing the configuration, there have been lever fitting-type connectors disclosed in PTL 1 and PTL 2. In the lever fitting-type connector disclosed in PTL 1 and PTL 2, a guide groove 3 extending in an elongating direction of the lever 1, and a rotation hole communicating with the guide groove 3 at the end of the guide groove 3, are formed on each of the sides of a lever 1. In the plug housing 8, a pair of boss portions (guide pins) 9 are formed to project outward from outer walls of the plug housing 8, and a pair of hemispherical protrusions (locking protrusions) 10 having a substantially hemispherical shape are provided to protrude from the plug housing. Particularly, the boss portions (guide pins) 9 have a substantially ellipsoidal shape with both vertical ends of a circular cylindrical shape cut out. In other words, a portion having a width of great dimensions and a portion having a width of small dimensions are formed. Also, the boss portions (guide pins) 9 engage with the guide grooves 3 of the lever 1, respectively.

According to the configuration, the lever 1 is inserted in the vehicle-side connector in a state (upright state) in which rotation of the lever is not performed with respect to the plug housing 8, then, as illustrated in FIG. 22, the lever 1 is pushed in a Y direction, and the lever 1 is caused to slide to a predetermined locking position after the lever 1 is in a state (prone state) of being parallel to the Y direction with the boss portions (guide pins) 9 as a rotational axis. In such a configuration, the pushing-in operation (sliding operation) allows the lever fitting-type connector to be fitted in the vehicle-side connector and electrical connection is performed with a signal terminal 15 in a lever cylinder 2 engaging with the female electrode in the fitting-detecting female connector (not illustrated), and attachment of the lever fitting-type connector is notified (detected).

PTL 1 is JP-A-2003-100385, and PTL 2 is JP-A-2012-59554.

SUMMARY OF THE INVENTION

In the lever fitting-type connector disclosed in PTL 1, as illustrated in FIG. 23(*a*) illustrating a sectional view taken along line F-F illustrated in FIG. 22, in the configuration, when the lever 1 is switched from the upright state to the prone state, hemispherical protrusions 10 engage with the guide grooves 3 and the prone state of the lever 1 can be temporarily maintained. In a state in which the lever 1 is only in a prone position, that is, in a state in which the hemispherical protrusions 10 engage with the guide grooves 3, as illustrated in FIG. 23(*b*), the signal terminal 15 in the lever cylinder 2 is separated from a female electrode 19 in a fitting-detecting female connector 18. Hence, in this state, with a signal line 20 connected to the female electrode 19, the main unit of the power circuit cutoff device is notified via the signal line 20 that the signal terminal 15 is not electrically connected to the female electrode 19.

Next, the lever 1 is caused to slide to the locking position in the Y direction in FIG. 22, thereby, as illustrated in FIG. 24(*a*), allowing the hemispherical protrusion 10 to engage with a locking hole 4 formed on the sides of the lever 1. As illustrated in FIG. 24(*b*), the sliding allows the fitting-detecting female connector 18 to be fitted in the lever cylinder 2 and the signal terminal 15 is fitted in the female electrode 19, thereby allowing electrical connection of the signal terminal 15 with the female electrode 19 to be notified via the signal line 20.

In comparison, as illustrated in FIGS. 23(*a*) to 25(*a*), in a lever fitting-type connector of the related art, a recessed portion 27 is formed in a region between the guide groove 3 and the locking hole 4. In such a configuration, the hemispherical protrusion 10 engages with the recessed portion 27 at a position at which the boss portion (guide pin) 9 moves to the guide groove 3 from the rotation hole, and the recessed portion 27 enables the boss portion (guide pin) 9 to be temporarily held at a position on a side close to the rotation hole of the guide groove 3. Here, in the configuration, the fitting-detecting female connector 18 is fitted in the lever cylinder 2 to a midway position and the signal terminal 15 is not electrically connected with the female electrode 19.

However, in the lever fitting-type connector of the related art, in a case where the lever 1 is caused to slide so as to be pushed in after the lever 1 is switched from the upright state to the prone state, the hemispherical protrusion 10 is allowed to move through the recessed portion 27 when the hemispherical protrusion reaches a position of the locking hole 4 illustrated in FIG. 24(*a*) from a position of the guide groove 3 illustrated in FIG. 23(*a*). In this case, since the hemispherical protrusion 10 moves from the guide groove 3 to the recessed portion 27, first, an operator has the first sense of an operation click felt when the hemispherical protrusion 10 runs over a sidewall of the guide groove 3 and reaches the bottom of the recessed portion 27. Then, since the hemispherical protrusion 10 is allowed to move from the recessed portion 27 to the locking hole 4, the operator has the second sense of the operational click felt when the hemispherical protrusion 10 runs over a sidewall of the recessed portion 27 and engages with the locking hole 4.

However, in a case where an operator who is unskilled for the operation of the lever fitting-type connector pushes in the lever 1 and performs the operation of the engagement of the hemispherical protrusion 10 with the locking hole 4 after operating the lever 1 from the upright state to the prone state, there is a concern that the operator will mistake the first sense of the operational click as the sense of the operational click felt when the hemispherical protrusion 10 engages with the locking hole 4 and will stop the sliding operation of the lever 1 at a midway position. In this case, as described above, in the configuration, the fitting-detecting female connector 18 engages with the lever cylinder 2 to a midway position, and the signal terminal 15 is not electrically connected to the female electrode 19; however, as illustrated in FIG. 25(*b*), there is a concern that, in some cases, incomplete sliding of the lever 1 will result in a midway insertion state in which the signal terminal 15 is electrically connected to the female electrode 19, and an incomplete sliding operation of the lever 1 is likely to be performed. Particularly, in a case where the fitting-detecting female connector 18 is fitted in the lever cylinder 2 to the midway position, the power circuit cutoff device stops supplying of driving power when the signal terminal 15 is disconnected from the female electrode 19 due to vibration of the vehicle or the like during driving of the vehicle. Therefore, solutions are demanded.

The present invention is provided in consideration of the problems and an object of the present invention is to provide a lever fitting-type connector in which it is possible to lower the peak of an operational force in the second half of a sliding operation during the sliding operation of a lever.

In order to achieve the object described above, a lever fitting-type connector according to the present invention is characterized by the following (1) to (6).

(1) A lever fitting-type connector of a power circuit cutoff device performing supplying of and cutting off of power from a power supply with the lever fitting-type connector fitted in and separated from a vehicle connector disposed on a vehicle side, the lever fitting-type connector includes: a plug housing that has a pair of guide pins provided to project outward from outer wall surfaces of facing sidewalls, respectively; a lever that has guide grooves, into which the guide pins are inserted, in facing sidewalls, and that straddles the plug housing so as to be pivotably and slidably supported with respect to the plug housing; a contact member that is formed in one wall surface of an inner wall surface of a sidewall of the lever with the guide groove formed, and an outer wall surface of the plug housing with the guide pin formed; and a triangular recess with which the contact member comes into contact during sliding of the lever, and which is formed in a region from a sliding start position of the lever to a sliding end position of the lever, in the inner wall surface of the lever or the outer wall surface of the plug housing, in which the contact member is not formed. The triangular recess includes a first inclined surface that extends in a direction from the sliding start position toward the sliding end position of the lever and that is inclined in a projecting direction of the contact member, and a second inclined surface that extends in a direction from an edge of the first inclined surface on the sliding end position side toward the sliding end position and that is inclined in a direction opposite to the projecting direction of the contact member. With a sliding direction of the lever as a reference, an inclined angle of the second inclined surface is smaller than an inclined angle of the first inclined surface.

(2) The lever fitting-type connector according to (1) above, includes: a first terminal that is attached to a first fitting portion formed in a side portion of the lever; and a second terminal that is attached to a second fitting portion formed in the vehicle connector. The first fitting portion and the second fitting portion are fitted at the sliding end position of the lever and the first terminal and the second terminal are electrically connected. In a case where the contact member comes into contact with a position at which an end of the first inclined surface intersects with an end of the second inclined surface, at least the first terminal and the second terminal are separated from each other.

(3) In the lever fitting-type connector according to (1) or (2) above, the contact member is formed in the outer wall surface of the plug housing, and the triangular recess is formed in the inner wall surface of the lever.

(4) A lever fitting-type connector of a power circuit cutoff device performing supplying of and cutting off of power from a power supply with the lever fitting-type connector fitted in and separated from a vehicle connector disposed on a vehicle side, the lever fitting-type connector includes: a plug housing that has a pair of guide pins provided to project outward from outer wall surfaces of facing sidewalls, respectively; a lever that has guide grooves, into which the guide pins are inserted, in facing sidewalls, and that straddles the plug housing so as to be pivotably and slidably supported with respect to the plug housing; a contact member that is formed in one of the lever with the guide groove formed, and an outer wall surface of a ceiling wall of the plug housing with the guide pin formed; and a triangular protrusion with which the contact member comes into contact during sliding of the lever, and which is formed in a region from a sliding start position of the lever to a sliding end position of the lever, in the lever or the outer wall surface of the plug housing, in which the contact member is not formed. The triangular protrusion includes a first inclined surface that extends in a direction from the sliding end position toward the sliding start position of the lever and that is inclined toward the contact member side, and a second inclined surface that extends from an edge of the first inclined surface on the sliding start position side of the lever to an end region of the plug housing which is the sliding start position of the lever and that is inclined toward a side opposite to the contact member side. With a sliding direction of the lever as a reference, an inclined angle of the second inclined surface is smaller than an inclined angle of the first inclined surface.

(5) The lever fitting-type connector according to (4) above, further includes: a first terminal that is attached to a first fitting portion formed in a side portion of the lever; and a second terminal that is attached to a second fitting portion formed in the vehicle connector. The first fitting portion and the second fitting portion are fitted at the sliding end position of the lever and the first terminal and the second terminal are electrically connected. In a case where the contact member comes into contact with the end region of the plug housing which is the sliding start position of the lever, at least the first terminal and the second terminal are separated from each other.

(6) In the lever fitting-type connector according to (4) or (5) above, the contact member is formed in the lever, and the triangular protrusion is formed in the ceiling wall of the plug housing.

According to (1) above, the triangular recess brought into contact with the contact member is configured to include the first inclined surface that extends in the direction from the sliding start position toward the sliding end position of the lever and that is inclined in the projecting direction of the contact member, and the second inclined surface that extends in the direction from the edge of the first inclined surface on the sliding end position side toward the sliding end position and that is inclined in the direction opposite to the projecting direction of the contact member. Further, with the sliding direction of the lever as a reference, the inclined angle of the second inclined surface is smaller than the inclined angle of the first inclined surface. Hence, since it is possible to lower the peak of a reaction force from the triangular recess that is received by the lever when the lever is caused to slide from the sliding start position to the sliding end position, the following effect is obtained. It is possible to cause the lever to easily move to the sliding end position at once, when the operator performs the sliding operation of the lever.

According to (2) above, in a case where the contact member comes into contact with the position at which the end of the first inclined surface intersects with the end of the second inclined surface, at least the first terminal and the second terminal are separated from each other. Hence, in the case where the sliding of the lever is ended at the midway position, a force in the sliding direction that is applied to the contact position at which the contact member is in contact with the second inclined surface causes the lever to be retracted to a position at which the contact member comes into contact with the position at which the end of the first inclined surface intersects with the end of the second inclined surface. Therefore, the following effect is obtained. It is possible to prevent erroneously notifying the power circuit cutoff device of the connection of the first terminal with the second terminal.

According to (4) above, the triangular protrusion brought into contact with the contact member is configured to include the first inclined surface that extends in the direction from the sliding end position toward the sliding start position of the lever and that is inclined toward the contact member side, and the second inclined surface that extends from the edge of the first inclined surface on the sliding start position side of the lever to the end region of the plug housing which is the sliding start position of the lever and that is inclined toward the side opposite to the contact member side. Further, with the sliding direction of the lever as a reference, the inclined angle of the second inclined surface is smaller than the inclined angle of the first inclined surface. Hence, since it is possible to lower the peak of a reaction force from the triangular protrusion that is received by the lever when the lever is caused to slide from the sliding start position toward the sliding end position, the following effect is obtained. It is possible to cause the lever to easily move to the sliding end position at once, when the operator performs the sliding operation of the lever.

According to (5) above, in a case where the contact member comes into contact with the end region of the plug housing which is the sliding start position of the lever, at least the first terminal and the second terminal are separated from each other. Hence, in the case where the sliding of the lever is ended at the midway position, a force in the sliding direction that is applied to the contact position at which the contact member is in contact with the second inclined surface causes the lever to be retracted to the end region of the plug housing which is the end of the second inclined surface on the lower side. Therefore, the following effect is obtained. It is possible to prevent erroneously notifying the power circuit cutoff device of the connection of the first terminal with the second terminal.

According to the present invention, it is possible to provide a lever fitting-type connector in which it is possible to lower the peak of an operational force in the second half of a sliding operation during the sliding operation of the lever.

DETAILED DESCRIPTION OF THE EXEMPLARY EMBODIMENTS

Figure 1:
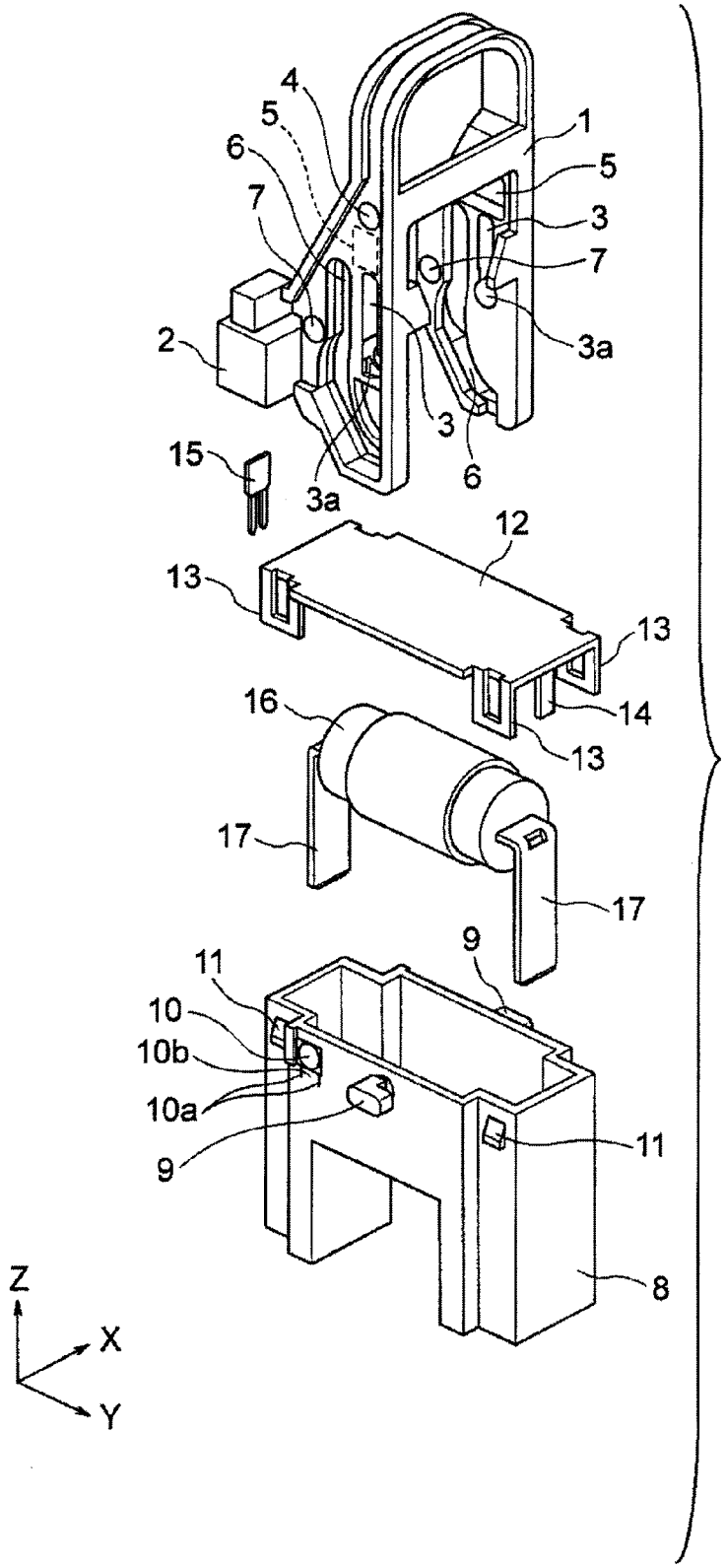
FIG. 1 is an exploded perspective view for depicting a schematic configuration of a lever fitting-type connector in a lever fitting-type power circuit cutoff device of a first embodiment of the present invention.

Hereinafter, embodiments to which the present invention is applied will be described with respect to the drawings. Here, in the following description, the same reference signs are assigned to the same components and description thereof is not repeated. In addition, X, Y, and Z in the drawings represent an X axis, a Y axis, and a Z axis, respectively.

First Embodiment

<Overall Configuration>

Figure 2:
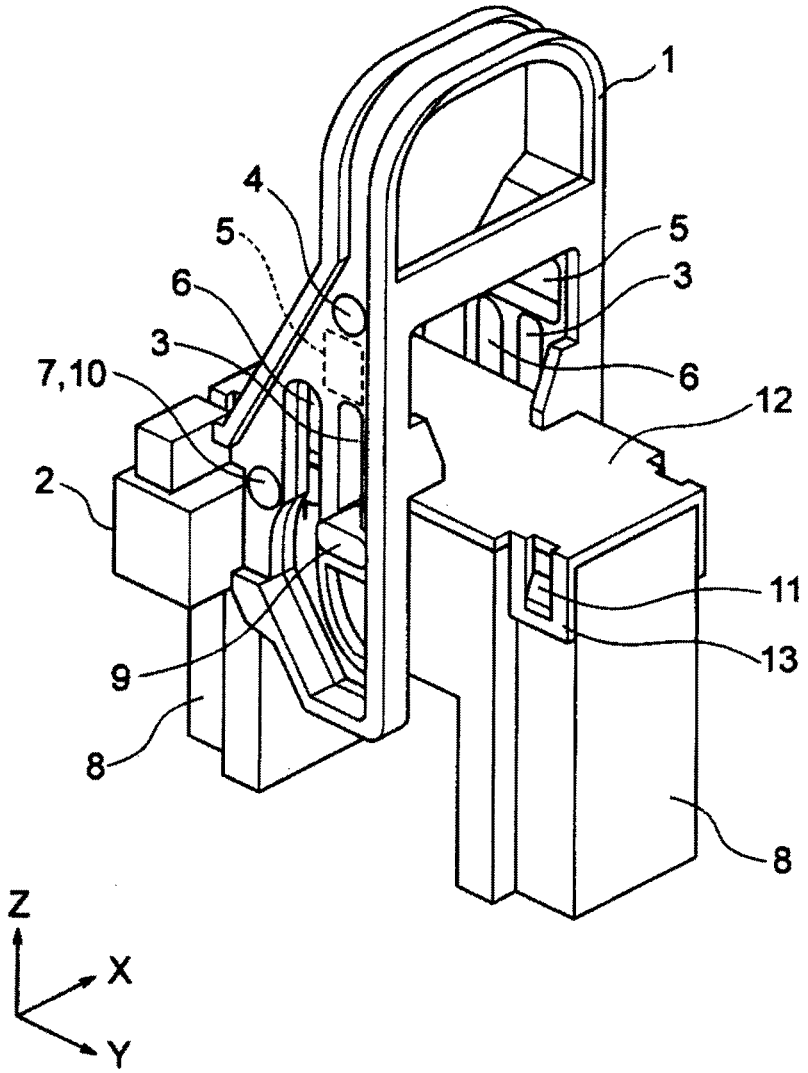
FIG. 2 is a perspective view for depicting the schematic configuration of the lever fitting-type connector of the first embodiment of the present invention.
Figure 3:
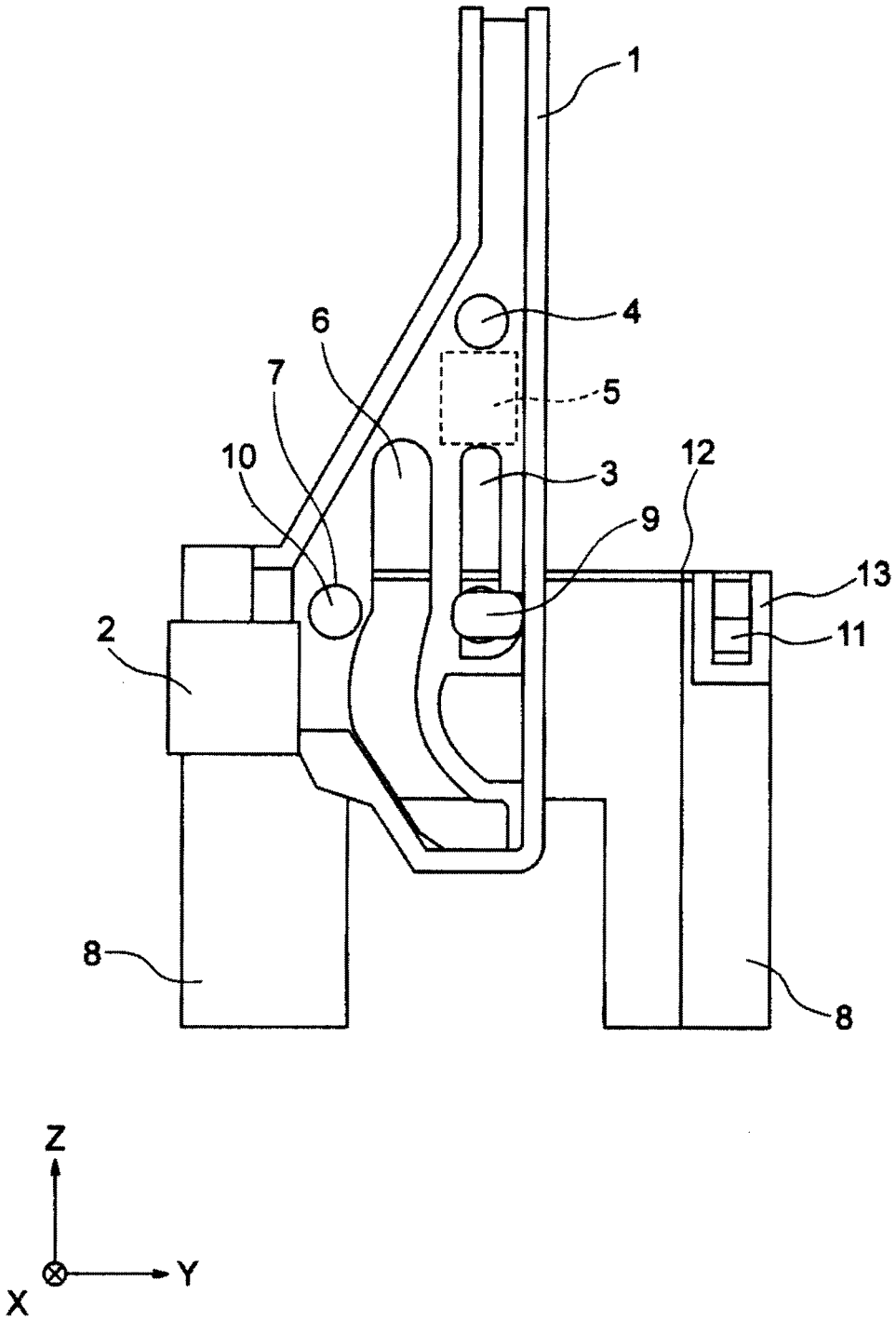
FIG. 3 is a side view for depicting the schematic configuration of the lever fitting-type connector of the first embodiment of the present invention.

FIG. 1 is an exploded perspective view for depicting a schematic configuration of a lever fitting-type connector in a lever fitting-type power circuit cutoff device of the first embodiment of the present invention. FIG. 2 is a perspective view for depicting the schematic configuration of the lever fitting-type connector of the first embodiment of the present invention. FIG. 3 is a side view for depicting the schematic configuration of the lever fitting-type connector of the first embodiment of the present invention. Hereinafter, configurations of a lever 1 and a plug housing 8 constituting the lever fitting-type connector of the first embodiment are described with reference to FIGS. 1 to 3. Here, since other configurations except for a configuration of a triangular recess 5 formed on the inner wall sides of facing side portions of the lever 1 are the same as the configuration of the lever fitting-type connector having a cam mechanism (cam groove 6) in the related art, the configuration of the triangular recess 5 will be described in detail in the following description. In addition, since a vehicle-side connector (not illustrated) which is fitted in the lever fitting-type connector of the first embodiment also has the same configuration as in the related art, only a fitting-detecting female connector 18 included in the vehicle-side connector will be described in detail.

As described in FIG. 1, the lever fitting-type connector (also referred to as a service plug) of the first embodiment is configured to include the substantially U-shaped lever 1, the plug housing 8 that holds the lever 1 such that the lever is pivotable and straightly slidable in a Y direction, and a cover (housing cover) 12 that covers the top surface of the plug housing 8. Further, in the following description, simply, the plug housing 8 means the plug housing 8 including the cover 12 that covers the top surface of the plug housing 8, for concise description.

The lever 1 includes a guide groove 3, a rotation hole 3*a*, a locking hole 4, a cam groove 6, and a holding hole 7, which are formed in each of the facing side portions (arm side portions) of the substantially U-shaped lever 1, and each is formed to penetrate the side portion of the lever 1. The guide groove 3 is a guide groove that restricts a sliding direction of the lever 1, has substantially the same width as a width of a boss portion (guide pin) 9 having a circular cylindrical shape of which vertical (Z direction) ends are cut out, and extends in an elongating direction of the lever 1. According to the configuration, a slidable state of the lever 1 is restricted to a case of a prone state, and the direction thereof is restricted to straight sliding performed parallel to the Y direction (extending direction of the guide groove 3). The rotation hole 3*a* is formed to communicate with the guide groove 3, and particularly, is formed at an end of the guide groove 3 on the rear end side of the lever 1, that is, on a side opposite to the Z direction in FIG. 1.

In addition, the locking hole 4 is formed on the front end side of the lever 1 from the guide groove 3, that is, on the upper side (Z direction side) in FIG. 1, and is formed on an extended line from the guide groove 3 in the elongating direction. In this respect, with respect to the rotation hole 3*a*, the holding hole 7 is configured to be disposed in a direction orthogonal to the elongating direction of the guide groove 3, and in a direction opposite to the Y direction in FIG. 1, and an interval from the end of the guide groove 3 on the front end side to the locking hole 4 is equal to an interval from the rotation hole 3*a* to the holding hole 7. According to the configuration, as will be described in detail below, a hemispherical protrusion (contact member or locking protrusion) 10 engages with the holding hole 7 in an upright state of the lever 1 (a position at which the lever 1 is parallel to the Z direction, that is, an upright position), and the hemispherical protrusion 10 engages with the locking hole 4 after the lever 1 is operated to slide to the prone state (a position at which the lever 1 is parallel to the Y direction, that is, a prone position).

Further, the lever fitting-type connector of the first embodiment also employs a configuration in which a box-shaped lever cylinder (first fitting portion) 2 is formed to protrude from the side portion of the lever 1 and to be opened on the rear end side of the lever 1, that is, on the side of the rotation hole 3*a*, and a signal terminal 15 is fixed in the lever cylinder 2.

The above configuration is the same as the configuration of the lever 1 in the related art; however, the lever 1 of the first embodiment employs a configuration in which the triangular recess 5 which is formed of two inclined surfaces inclined in the Z direction, in a region between the guide groove 3 and the locking hole 4, in an inner wall surface of the lever 1. Further, the detailed configuration of the triangular recess 5 formed in the inner wall surface of the lever 1 will be described below.

The plug housing 8 is configured to be the same as a plug housing in the related art, the top surface of the U-shaped plug housing 8 is configured to have an opening, and a fuse 16 is inserted into the inside from the opening and is disposed inside the plug housing 8. Here, a pair of electrodes (male electrodes) (not illustrated) are disposed inside the plug housing 8, and the fuse electrodes 17 at both ends of the fuse 16 are fitted in and are electrically connected to the pair of electrodes (not illustrated). Further, the pair of electrodes (male electrodes) are connected to female-side electrodes of a vehicle connector (not illustrated).

In addition, in outer side surfaces (outer wall surfaces) of the sidewalls of the plug housing 8 on the sides orthogonal to the X direction, a pair of guide pins 9 are provided to project outward (the X direction and the direction opposite to the X direction, that is, an outer-side direction) from the sidewalls thereof, respectively.

In addition, in the outer wall surfaces of the plug housing 8 on the sides orthogonal to the X direction, a pair of hemispherical protrusions 10 having a substantially hemispherical shape are provided so as to be juxtaposed with the guide pins 9 in the Y direction. Here, the hemispherical protrusions 10 are formed in a flexible arm 10*b* formed between a pair of slits 10*a* (not illustrated) which are formed in the plug housing 8 formed of a resin member. According to the configuration, the pair of hemispherical protrusions 10 easily move inward (an inner-side direction) in the plug housing 8 due to elastic bending deformation of the flexible arm 10*b*, and the pair of hemispherical protrusions 10 are configured be inserted in or comes into contact with (pressed against) the guide grooves 3, the locking holes 4, the holding holes 7, and the triangular recess 5 of the lever 1.

Further, in the outer wall surface of corners of the plug housing 8 along the opening, claw portions 11 are configured to be provided to protrude outward from the sidewalls and to be fitted in fixing portions 13 formed on the corners of the cover 12. Here, a projecting portion 14 projecting from the cover 12 comes into contact with the inner wall surface of the plug housing 8 and the position of the cover 12 is prevented from being shifted.

As illustrated in FIGS. 2 and 3, in the configuration of the lever fitting-type connector of the first embodiment employing the above configurations, the fuse 16 is inserted in the plug housing 8, and the opening in the top surface through which the fuse 16 is inserted is covered with the cover 12. Here, the claw portion 11 protruding from the plug housing 8 is fitted in the fixing portion 13 formed on the corners of the cover 12 and the cover 12 is fixed to the opening portion of the plug housing 8.

In addition, the pair of guide pins 9 protruding from the sidewalls of the plug housing 8 are inserted into the rotation holes 3*a* (including the guide grooves 3) of the lever 1 disposed to straddle the plug housing 8. Here, in the case where the guide pins 9 are positioned in the rotation holes 3*a*, the lever 1 is supported so as to be rotatable about the guide pins 9 between the upright state and the prone state. In comparison, in the case where the guide pins 9 are positioned in the guide grooves 3, the lever 1 is supported so as to be slidable in the Y direction (including a −Y direction) as will be described below.

Particularly, as is clear from FIG. 3, the lever fitting-type connector of the first embodiment employs the configuration in which the hemispherical protrusion 10 engages with the holding hole 7 in the upright state in which the direction of the lever 1 is matched with an insertion/removal direction of the lever fitting-type connector, and the upright state is maintained. Further, a configuration may be employed, in which the holding hole 7 for maintaining the upright state is not provided.

<Detailed Configuration of Triangular Recess>

Figure 4:
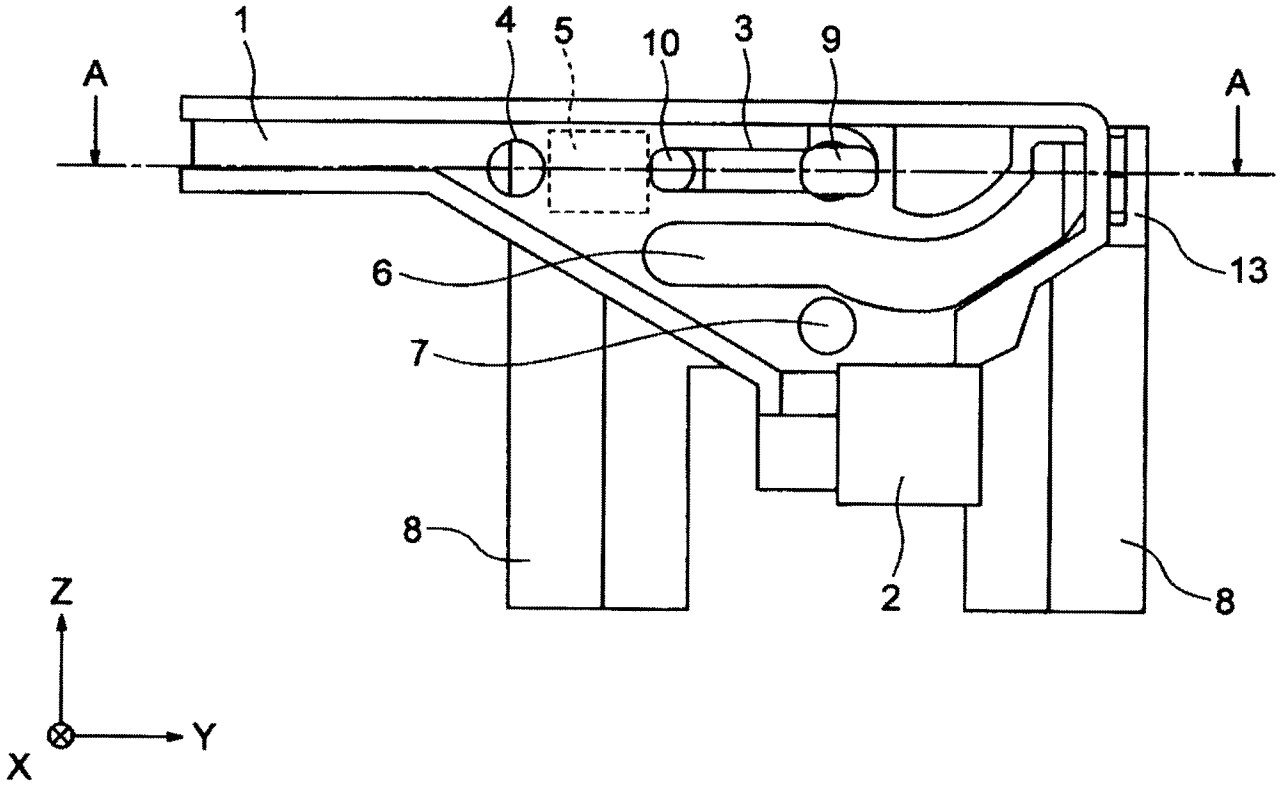
FIG. 4 is a side view for depicting the schematic configuration of the lever fitting-type connector in the lever fitting-type power circuit cutoff device of the first embodiment of the present invention.
Figure 5:
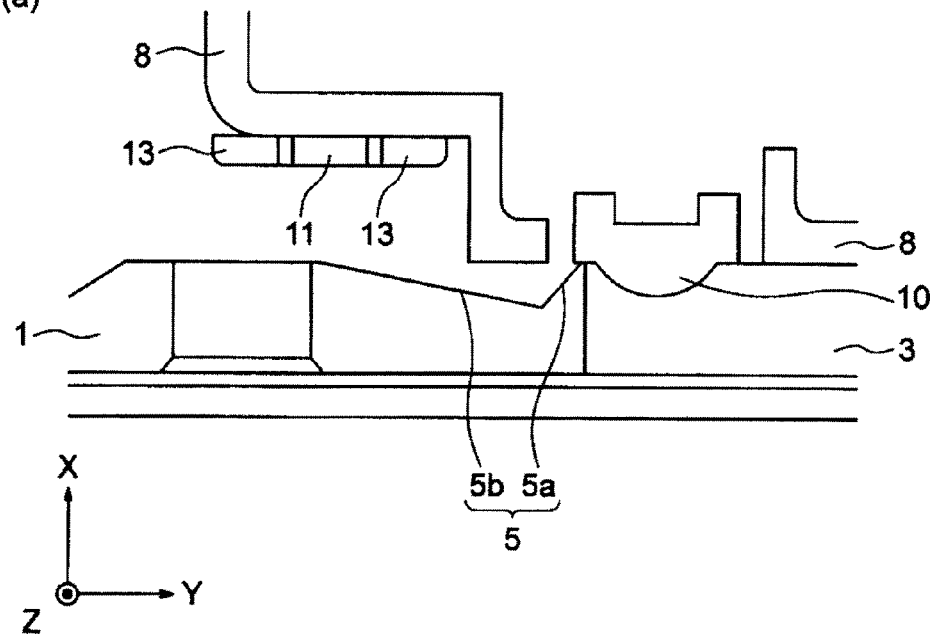
FIG. 5(*a*) is a sectional view taken along line A-A in FIG. 4, and FIG. 5(*b*) is a sectional view for depicting a detailed configuration of a triangular recess illustrated in FIG. 5(*a*).
Figure 5:
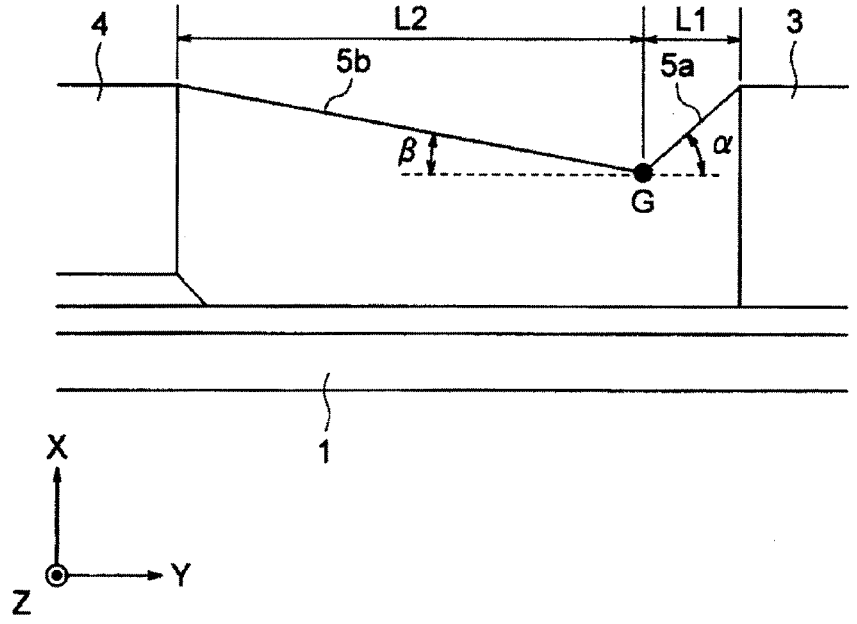
Figure 6:
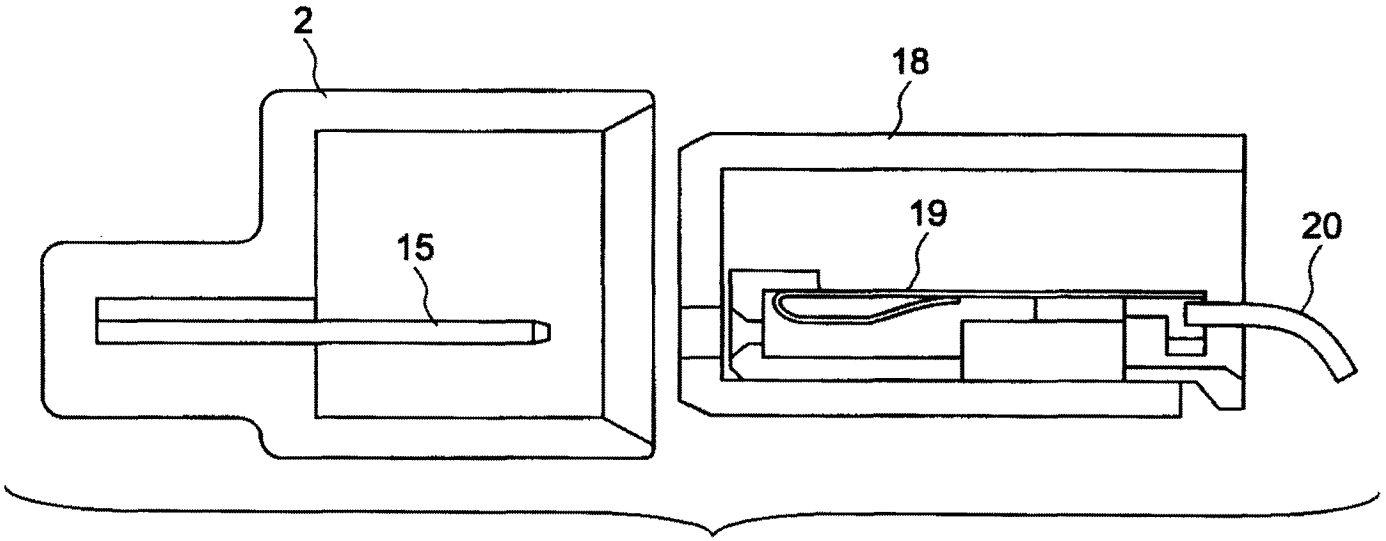
FIG. 6 is a view for depicting a positional relationship between a fitting-detecting female connector included in a vehicle-side connector and a lever cylinder of the lever fitting-type connector in the lever fitting-type power circuit cutoff device of the first embodiment of the present invention.
Figure 7:
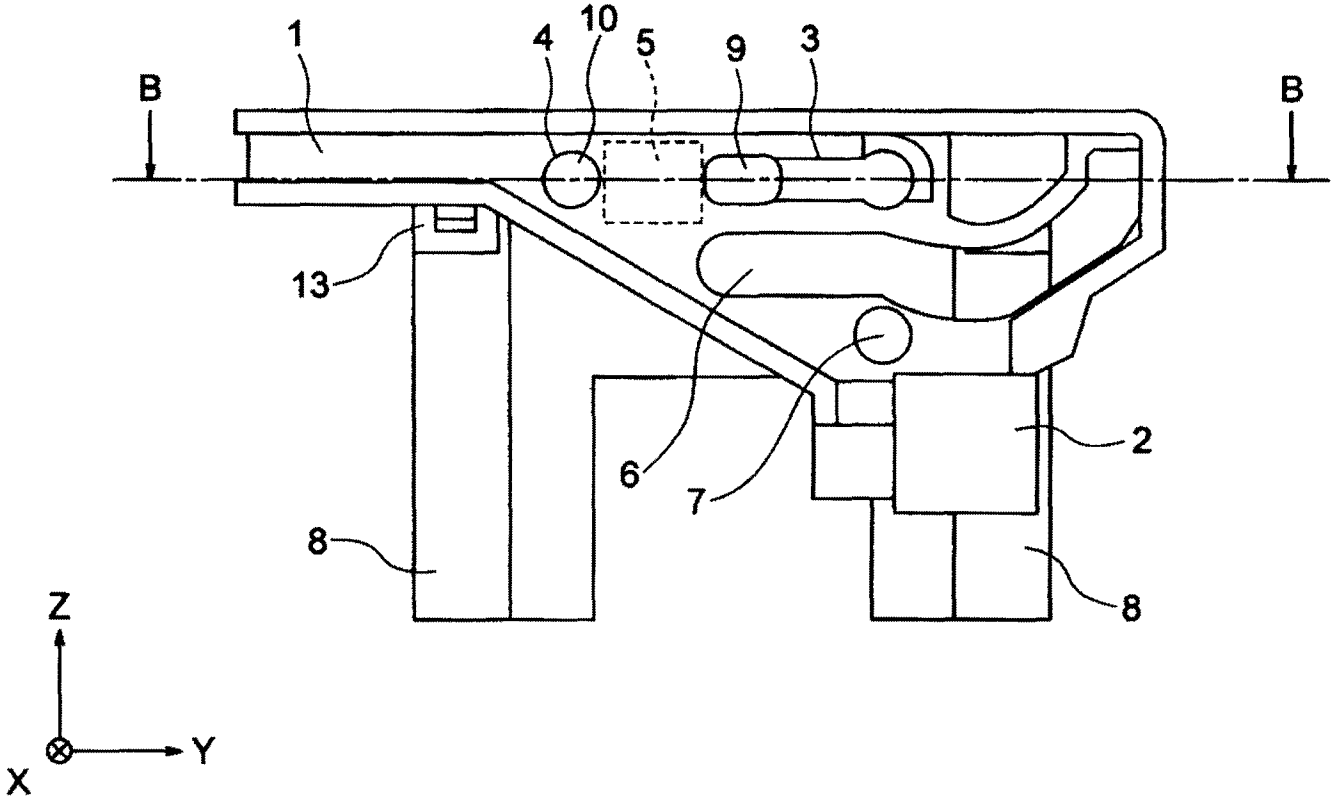
FIG. 7 is a side view for depicting the schematic configuration of the lever fitting-type connector in the lever fitting-type power circuit cutoff device of the first embodiment of the present invention.
Figure 8A:
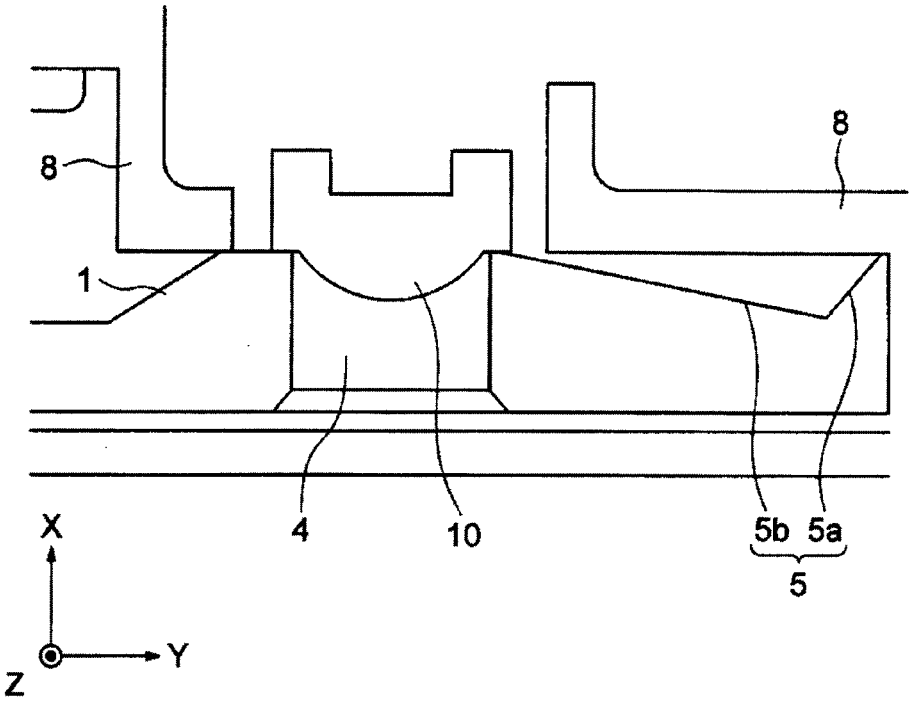
FIG. 8(*a*) is an enlarged sectional view taken along line B-B in FIG. 7, and FIG. 8(*b*) is a view for depicting a positional relationship between the lever cylinder and the fitting-detecting female connector.
Figure 8B:
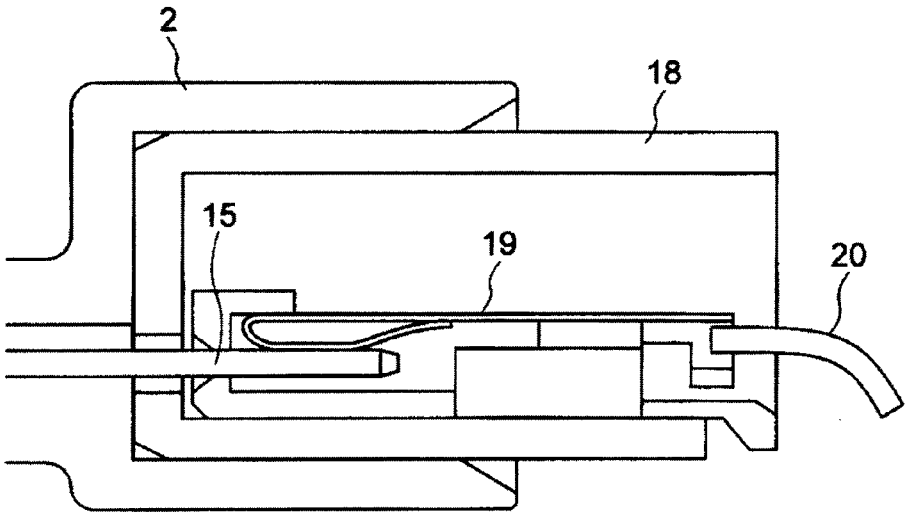

FIGS. 4 and 7 are side views for depicting the schematic configuration of the lever fitting-type connector in the lever fitting-type power circuit cutoff device of the first embodiment of the present invention. FIG. 5 illustrates sectional views taken along line A-A in FIG. 4. FIG. 6 is a view for depicting a positional relationship between a fitting-detecting female connector included in a vehicle-side connector (vehicle connector) and a lever cylinder of the lever fitting-type connector in the lever fitting-type power circuit cutoff device of the first embodiment of the present invention. FIG. 8 illustrates an enlarged sectional view taken along line B-B in FIG. 7, and a view for depicting a positional relationship between the lever cylinder and the fitting-detecting female connector. Here, FIG. 5(*a*) is an enlarged sectional view taken along line A-A in FIG. 4, and FIG. 5(*b*) is a sectional view for depicting the detailed configuration of the triangular recess 5 illustrated in FIG. 5(*a*). In addition, FIG. 8(*a*) is an enlarged sectional view taken along line B-B in FIG. 7, and FIG. 8(*b*) is a view for depicting a positional relationship between the lever cylinder and the fitting-detecting female connector.

Hereinafter, motion of the lever 1 during the sliding in the lever fitting-type connector of the first embodiment will be described with reference to FIGS. 4 to 8(*b*). Further, in the following description, the vehicle-side connector, which the lever fitting-type connector of the first embodiment is inserted into and removed from in the upright state, is omitted for concise description. Here, only FIGS. 6 and 8(*b*) illustrate the fitting-detecting female connector (second fitting portion) 18 and a female electrode 19 disposed in the female connector 18 which are included in the known vehicle-side connector which is fitted in the lever fitting-type connector of the first embodiment. In addition, the female electrode 19 is formed of a pair of electrodes which are electrically connected to a control circuit of the power circuit cutoff device (not illustrated) and the signal terminal 15 is fitted between the pair of female electrodes 19, thereby achieving a conduction state between the pair of female electrodes 19. Then, the conduction state is detected by the control circuit of the power circuit cutoff device (not illustrated) as notification of attachment of the lever fitting-type connector, and power supply is started from the power circuit cutoff device. In other words, in the configuration, the completion of the fitting of the lever fitting-type connector is detected from the signal terminal 15 in the lever cylinder 2 formed in the side surface portion of the lever 1, and the female electrode 19 disposed in the fitting-detecting female connector 18, and then, the power supply is started.

As illustrated in FIG. 4, after the lever fitting-type connector of the first embodiment is inserted in the vehicle-side connector, the guide pins 9 are positioned in the rotation holes 3*a*, immediately after the lever 1 is rotated from the upright state (upright position) to the prone state (prone position), that is, at a sliding start position, similarly to the lever fitting-type connector in the related art. In comparison, on the side away from the rotation hole 3*a* of the guide groove 3 communicating with the rotation hole 3*a*, the hemispherical protrusion 10 engages with the guide groove 3, as illustrated in FIG. 5(*a*). Here, as illustrated in FIG. 6, the lever cylinder 2 of the lever fitting-type connector is separated from the fitting-detecting female connector 18 included in the vehicle-side connector (not illustrated). Accordingly, since the signal terminal (first terminal) 15 disposed in the lever cylinder 2 is disposed to be separated from the female electrode (second terminal) 19 disposed in the fitting-detecting female connector 18, the attachment of the lever fitting-type connector is not notified (detected), that is, non-attachment of the lever fitting-type connector is notified (detected).

Here, as is clear from FIG. 5(*a*), the lever 1 of the first embodiment employs a configuration in which, in the inner wall of the lever 1, that is, in the sidewall surface disposed to face the plug housing 8, the triangular recess 5 is formed on a straight line connecting the guide groove 3 and the locking hole 4 in a region in which the hemispherical protrusion 10 comes into contact.

Particularly, as illustrated in FIG. 5(*b*), the triangular recess 5 of the first embodiment is formed to have a triangularly recessed shape formed of two inclined surfaces (first inclined surface 5*a* and second inclined surface 5*b*) having different inclined angles from each other, which are inclined in the elongating direction (Y direction in FIG. 4) from the vicinity of the guide groove 3. The first inclined surface 5*a* as one inclined surface is an inclined surface that gradually descends (become deep) in a straight line and reaches the deepest portion (represented by a point G in FIG. 5(*b*)), and the second inclined surface 5*b* as the other inclined surface is an inclined surface that gradually ascends (become shallow) in a straight line from the deepest portion of the first inclined surface 5*a* and reaches the edge of the locking hole 4.

In addition, the triangular recess 5 employs a configuration in which an inclination of the second inclined surface 5*b* is more gradual than that of the first inclined surface 5*a*, and, in a case where the inclined angle of the first inclined surface 5*a* is $\alpha$ and the inclined angle of the second inclined surface 5*b* is $\beta$ with respect to the elongating direction (sliding direction of the lever 1) of the lever 1, which is depicted by a dotted line in FIG. 5(*b*), the inclined angle $\beta$ of the second inclined surface 5*b* is smaller than the inclined angle $\alpha$ of the first inclined surface 5*a*. Hence, the triangular recess 5 of the first embodiment employs a configuration in which the second inclined surface 5*b* is longer than the first inclined surface 5*a* in length, and a distance L2 from the deepest portion G of the second inclined surface 5*b* to the edge of the locking hole 4 in the elongating direction of the lever 1 is greater (longer) than a distance L1 from the deepest portion G of the first inclined surface 5*a* to the edge of the guide groove 3. As a result, in the lever fitting-type connector of the first embodiment, it is possible to decrease a force (reaction force) produced on the triangular recess 5 when the lever 1 is caused to slide in the horizontal direction (Y direction), that is, produced in a direction (−Y direction) opposite to the sliding direction. In other words, in the lever fitting-type connector of the first embodiment, it is possible to lower the peak of a pressing force produced when the lever 1 is caused to slide in the horizontal direction (Y direction), that is, a pressing force that an operator receives from the lever 1.

In comparison, when the lever 1 is caused to slide in the horizontal direction (Y direction) from a position at which the hemispherical protrusion 10 illustrated in FIG. 5(*a*) engages with the guide groove 3, that is, a position (sliding start position) of the lever immediately after the lever 1 is caused to pivot to the prone position, to a locking position (fitting completion position of the lever fitting-type connector, that is, sliding end position) at which the hemispherical protrusion 10 illustrated in FIGS. 7(*a*) and 7(*b*) engages with the locking hole 4, the hemispherical protrusion 10 passes over the triangular recess 5 and engages with the locking hole 4. Here, as described above, the triangular recess 5 of the first embodiment employs the configuration in which the reaction force from the triangular recess 5 produced when the lever 1 is caused to slide in the horizontal direction (Y direction) is decreased. As a result, when an operator performs sliding operation of the lever 1, the following effects are obtained. It is possible to cause the lever 1 to slide to the locking position at once by the pressing force from the operator for causing the hemispherical protrusion 10 to run over the edge of the guide groove 3 and it is possible for the hemispherical protrusion 10 to easily engage with the locking hole 4.

In addition, as illustrated in FIG. 8(*b*), the lever 1 slides to the locking position at which the hemispherical protrusion 10 engages with the locking hole 4, thereby engaging the lever cylinder 2 formed in the lever 1 with the fitting-detecting female connector 18 included in the vehicle-side connector (not illustrated). Accordingly, the signal terminal 15 disposed in the lever cylinder 2 is fitted in and electrically connected to the female electrode 19 disposed in the fitting-detecting female connector 18, and the attachment of the lever fitting-type connector is notified (detected) to the main unit of the power circuit cutoff device through the signal line 20.

Figure 9:
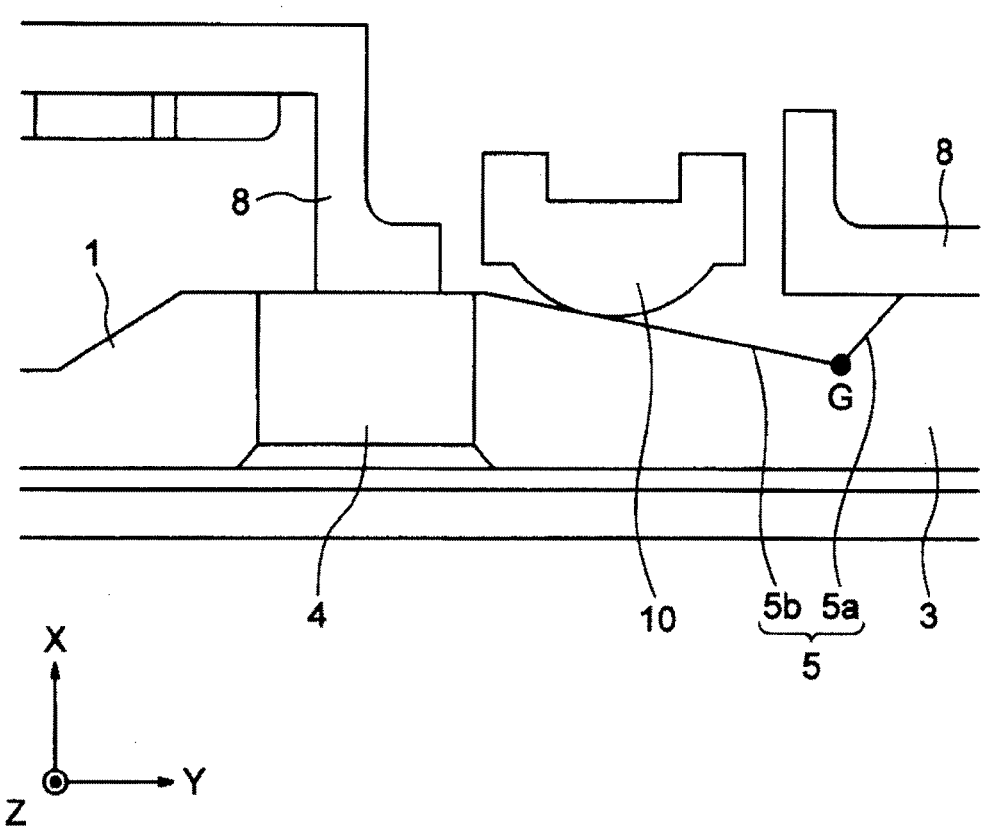
FIG. 9 is an enlarged sectional view of the triangular recess in a case where a hemispherical protrusion does not reach the triangular recess in the first embodiment of the present invention.
Figure 10A:
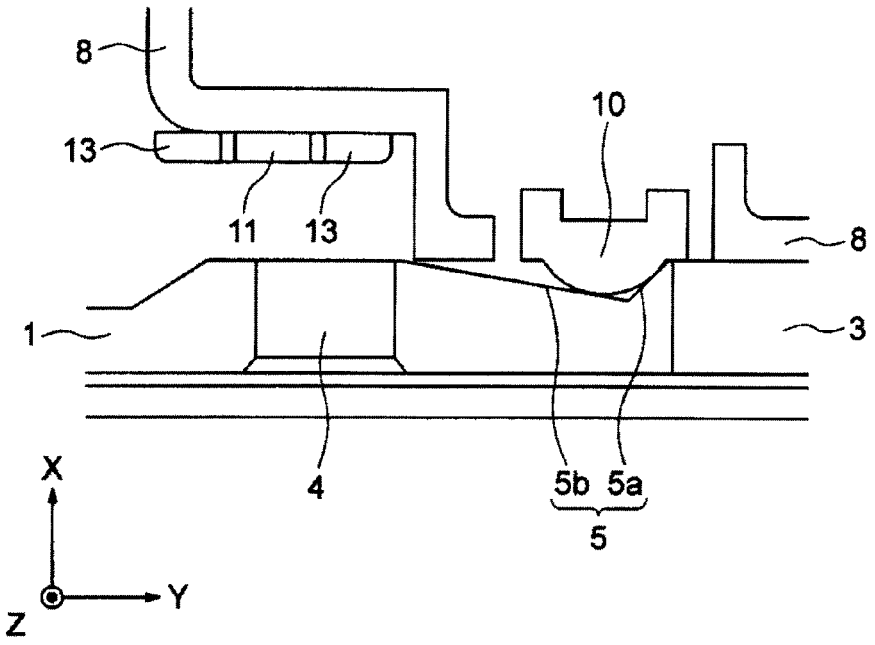
FIG. 10(*a*) is an enlarged sectional view of the triangular recess in a case where the hemispherical protrusion does not reach the triangular recess in the first embodiment of the present invention, and FIG. 10(*b*) is a view for depicting a positional relationship between the lever cylinder and the fitting-detecting female connector.
Figure 10B:
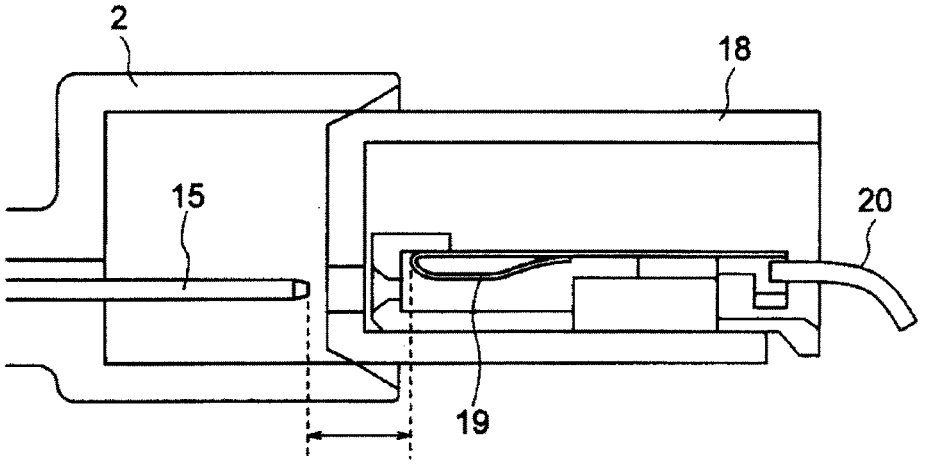

Next, FIGS. 9 and 10 are enlarged sectional views of the triangular recess in a case where the hemispherical protrusion does not reach the triangular recess in the first embodiment of the present invention and a preventing configuration of a midway insertion state in the first embodiment will be described in detail. FIGS. 9 and 10(*a*) correspond to FIGS. 5(*a*) and 8(*a*), and FIG. 10(*b*) corresponds to FIGS. 6 and 8(*b*).

As illustrated in FIG. 9, in a case where the lever 1 does not reach the locking position, that is, in a case where the sliding operation of the lever 1 is stopped in the region in which the hemispherical protrusion 10 comes into contact with the second inclined surface 5*b* of the triangular recess 5, the hemispherical protrusion 10 is pressed to the second inclined surface 5*b* due to the elastic bending deformation of the flexible arm 10*b* in which the hemispherical protrusion 10 is disposed. Hence, since a force in the −Y direction depending on the inclined angle $\beta$ of the second inclined surface 5*b* is applied to the lever 1, as illustrated in FIG. 10(*a*), the lever 1 slides such that the hemispherical protrusion 10 moves to the deepest portion G of the second inclined surface 5*b* (a position at which the first inclined surface 5*a* meets the second inclined surface 5*b*). As a result, as illustrated in FIG. 10(*b*), the signal terminal 15 disposed in the lever cylinder 2 is positioned to be separated from the female electrode 19 disposed in the fitting-detecting female connector 18. Hence, in the case where the hemispherical protrusion 10 is not fitted in the locking hole 4, it is also possible to obtain a remarkable effect that it is possible to prevent erroneous detection of the electrical connection of the signal terminal 15 with the female electrode 19.

Further, the lever fitting-type connector of the first embodiment employs the configuration in which the edge of the guide groove 3 is formed at the same height as the edge of the locking hole 4; however, a configuration in which the edges are formed at different heights from each other may be employed. For example, it is conceivable to employ a configuration having a low circumferential edge of the guide groove 3 over which the hemispherical protrusion 10 runs from the circumferential edge of the guide groove 3 to the first inclined surface 5*a* of the triangular recess 5. In this case, during the sliding operation of the lever 1, it is possible to obtain the effect that it is possible to lower the peak of the pressing force that an operator receives from the lever 1.

In addition, in the configuration of the present embodiment, the first inclined surface 5*a* and the second inclined surface 5*b* are formed to be continuous; however, a configuration may be employed, in which a parallel region (flat region) extending in the elongating direction (Y direction) of the lever 1 is formed between the first inclined surface 5*a* and the second inclined surface 5*b*, as long as the inclined angle β of the second inclined surface 5*b* can be formed to be sufficiently small. In this case, since a sense of operational click is significantly received, it is preferable to employ a configuration in which the size of the flat region in the elongating direction of the lever 1 is small. In other words, as described above, it is suitable to employ a configuration in which the first inclined surface 5*a* and the second inclined surface 5*b* are formed to be continuous without the flat region.

Further, the lever fitting-type connector of the first embodiment employs the configuration in which the triangular recess 5 is formed on the lever 1 side and the hemispherical protrusion 10 is formed on the plug housing 8 side; however, the configuration is not limited thereto. For example, a configuration may be employed, in which the hemispherical protrusion 10 is formed on the lever 1 side and the triangular recess 5, the locking hole 4, a locking hole corresponding to the guide groove 3, or the like is formed on the plug housing 8 side. In the configuration, it is also possible to obtain the effects described above by forming an inclined angle of one inclined surface on the locking hole 4 side that forms the triangular recess 5 which is smaller than an inclined angle of the other inclined surface.

Second Embodiment

Figure 11:
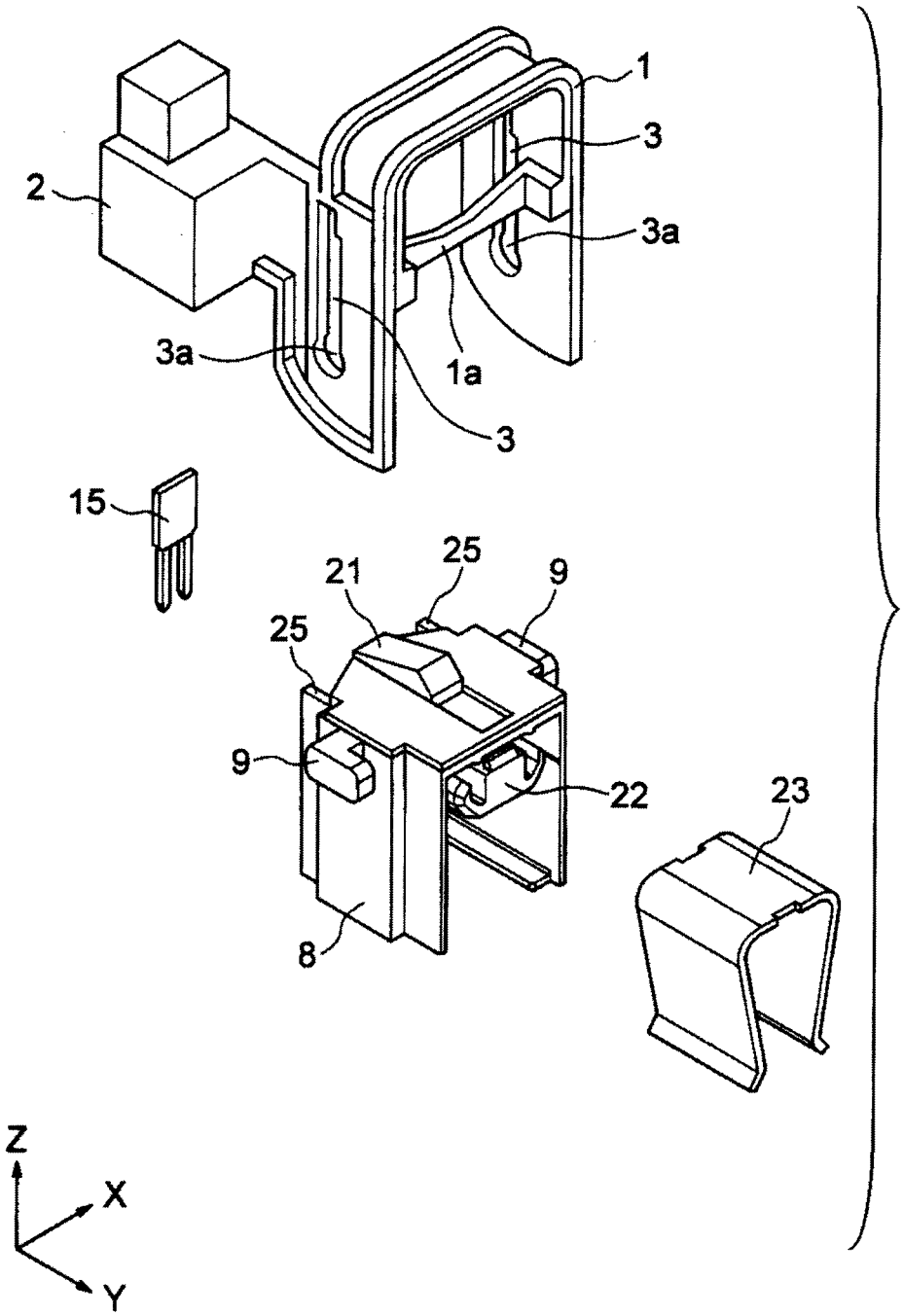
FIG. 11 is an exploded perspective view for depicting a schematic configuration of a lever fitting-type connector in a lever fitting-type power circuit cutoff device of a second embodiment of the present invention.
Figure 12:
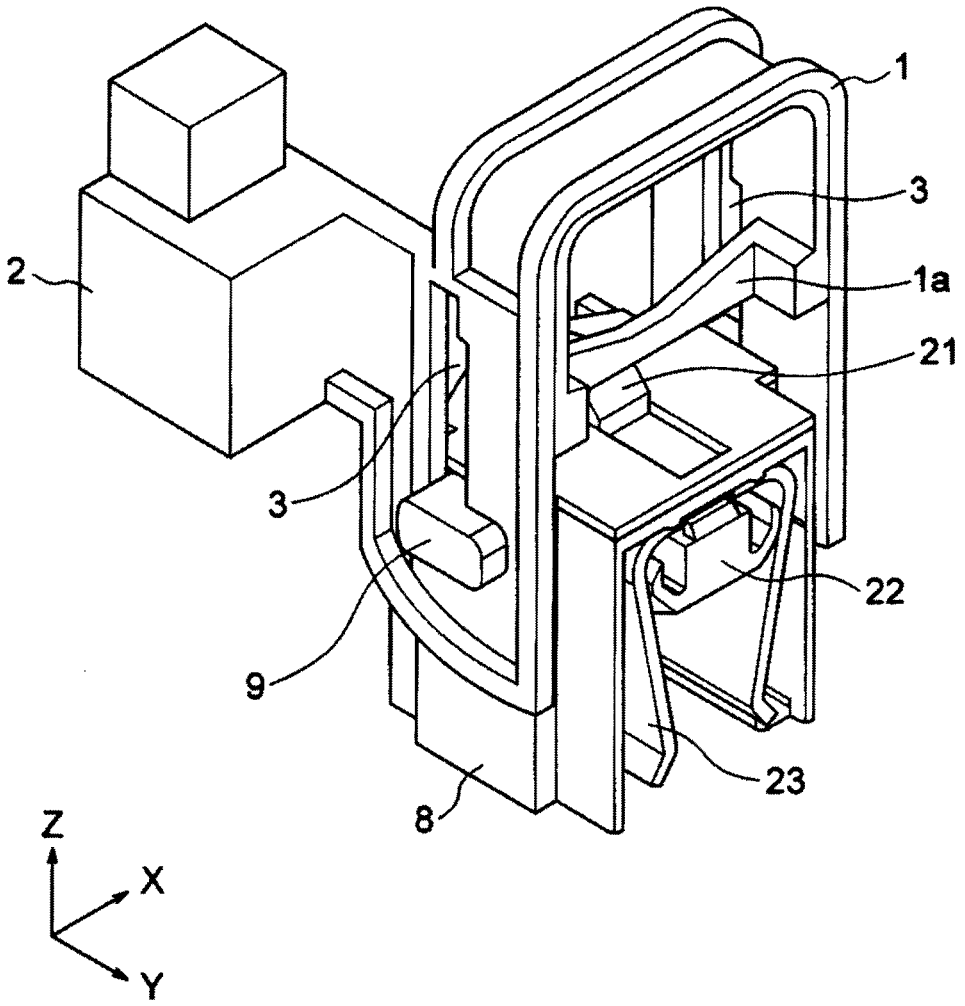
FIG. 12 is a perspective view for depicting the schematic configuration of the lever fitting-type connector of the second embodiment of the present invention.
Figure 13:
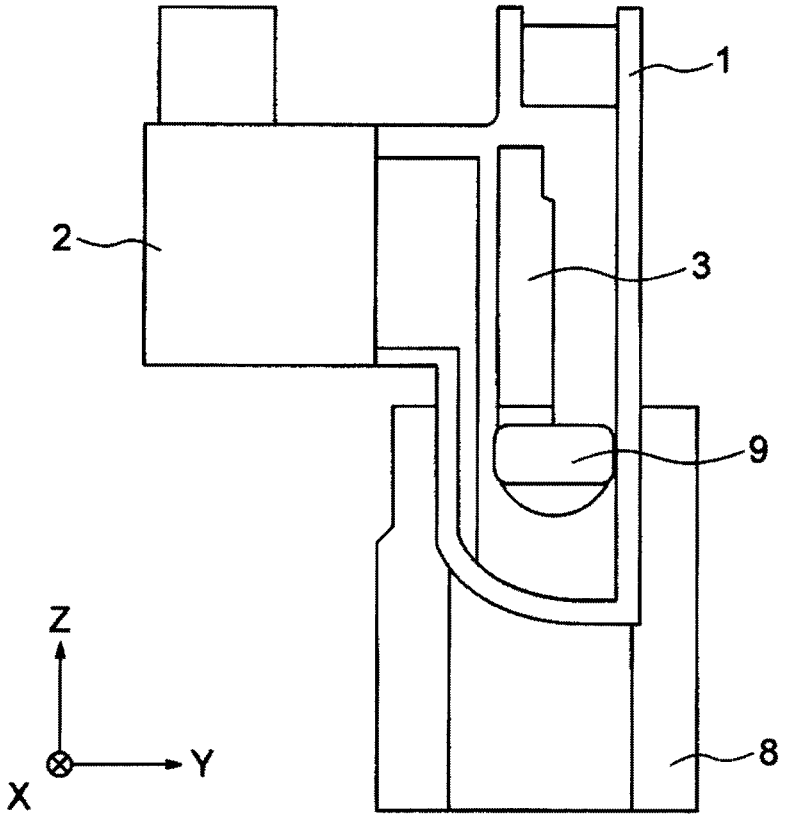
FIG. 13 is a side view for depicting the schematic configuration of the lever fitting-type connector of the second embodiment of the present invention.

FIG. 11 is an exploded perspective view for depicting a schematic configuration of a lever fitting-type connector in a lever fitting-type power circuit cutoff device of the second embodiment of the present invention. FIG. 12 is a perspective view for depicting the schematic configuration of the lever fitting-type connector of the second embodiment of the present invention. FIG. 13 is a side view for depicting the schematic configuration of the lever fitting-type connector of the second embodiment of the present invention. Hereinafter, configurations of the lever 1 and the plug housing 8 constituting the lever fitting-type connector of the second embodiment are described with reference to FIGS. 11 to 13. Here, since other configurations of the lever fitting-type connector of the second embodiment except for a configuration of a triangular protrusion 21 formed in the top surface of the plug housing 8 are the same as the configurations of the lever fitting-type connector which does not include a cam mechanism in the related art, the configuration of the triangular protrusion 21 will be described in detail in the following description. In addition, since the vehicle-side connector (not illustrated) which is fitted in the lever fitting-type connector of the second embodiment also has the same configuration as in the related art, only the fitting-detecting female connector 18 included in the vehicle-side connector will be described in detail.

As described in FIG. 11, the lever fitting-type connector of the second embodiment is configured to include the substantially U-shaped lever 1, the U-shaped plug housing 8 that holds the lever 1 in a pivotable and slidable manner, and a main terminal 23 connected to a female terminal of the vehicle-side connector (not illustrated).

The lever 1 includes the guide groove 3 that restricts the sliding direction of the lever 1, a rotation hole 3*a* that communicates with the guide groove, which are formed in each of the facing side portions of the substantially U-shaped lever 1, and each is formed to penetrate the side portion of the lever 1. The guide groove 3 of the second embodiment also has substantially the same width as the width of the guide pin 9 having a circular cylindrical shape of which vertical (Z direction) ends are cut out, and extends in the elongating direction of the lever 1.

In addition, recessed portions 24 that engage with protruding portions 25 included in the plug housing 8 are formed in the inner wall surfaces of the facing side portions of the lever 1. The recessed portion 24 engages with the projecting portion when the lever 1 is caused to slide to a determined position. Further, when the lever 1 is caused to pivot to the prone position, the guide groove 3 of the lever 1 engages with the protruding portion 25.

In addition, a lever beam (contact member) 1*a* that links the facing side portions is formed in the lever 1. Further, the lever fitting-type connector of the second embodiment also employs a configuration in which the box-shaped lever cylinder 2 is formed to protrude from the side portion of the lever 1 and to be opened on the rear end side of the lever 1, that is, on the side of the rotation hole 3*a*, and the signal terminal 15 is fixed in the lever cylinder 2.

In the plug housing 8, the triangular protrusion 21 is formed in the outer wall surface (top surface in FIG. 11) of the ceiling wall of the U-shaped plug housing 8 so as to project outward, and, as will be described in detail below, the lever beam 1*a* comes into contact with the triangular protrusion 21 during the sliding operation of the lever 1. Particularly, the triangular protrusion 21 of the second embodiment is configured to extend from the edge of the plug housing 8 which is the front end side (upper left side in FIG. 11) of the lever 1 in the prone position, in the sliding direction (Y direction) of the lever 1. Further, the triangular protrusion 21 of the second embodiment is formed at a position in the central portion of the guide pin 9 in the projecting direction, in the top surface of the plug housing 8 and is configured to extend in the sliding direction of the lever 1. Here, the forming position of the triangular protrusion 21 is not limited to the position in the central portion of the guide pin 9 in the projecting direction, but may be configured to be formed at a position close to one of the sides toward which the pair of guide pins 9 project. Additionally, the size of the triangular protrusion 21 in the sliding direction of the lever 1 will be described below.

In addition, other configurations of the plug housing 8 are the same as the configurations in the related art, and a sandwiching portion 22 that sandwiches the main terminal 23 between the top portion of the plug housing 8 and the sandwiching portion 22 is arranged inside a ceiling wall of the plug housing 8. Further, the pair of guide pins 9 are provided in the outer wall surfaces of the sidewalls of the plug housing 8 on the sides orthogonal to the X direction so as to project outward from the outer wall surface. Furthermore, the protruding portions 25 that protrude in the same direction as the guide pins 9 are formed at corners on the ceiling side of the plug housing 8.

As illustrated in FIGS. 12 and 13, in the configuration of the lever fitting-type connector of the second embodiment having the above configurations, the main terminal 23 is sandwiched by the sandwiching portion 22 in the plug housing 8 and the main terminal 23 is covered with the sidewalls of the plug housing 8. In addition, the pair of guide pins 9 protruding from the sidewalls of the plug housing 8 are inserted into the rotation holes 3*a* (including the guide grooves 3) of the lever 1 disposed to straddle the plug housing 8. Here, in the case where the guide pins 9 are positioned in the rotation holes 3*a*, the lever 1 is supported so as to be rotatable about the guide pins 9 between the upright position and the prone position. In comparison, in the case where the guide pins 9 are positioned in the guide grooves 3, the lever 1 is supported so as to be slidable in the Y direction (including the −Y direction) as will be described below.

<Detailed Configuration of Triangular Protrusion>

Figure 14:
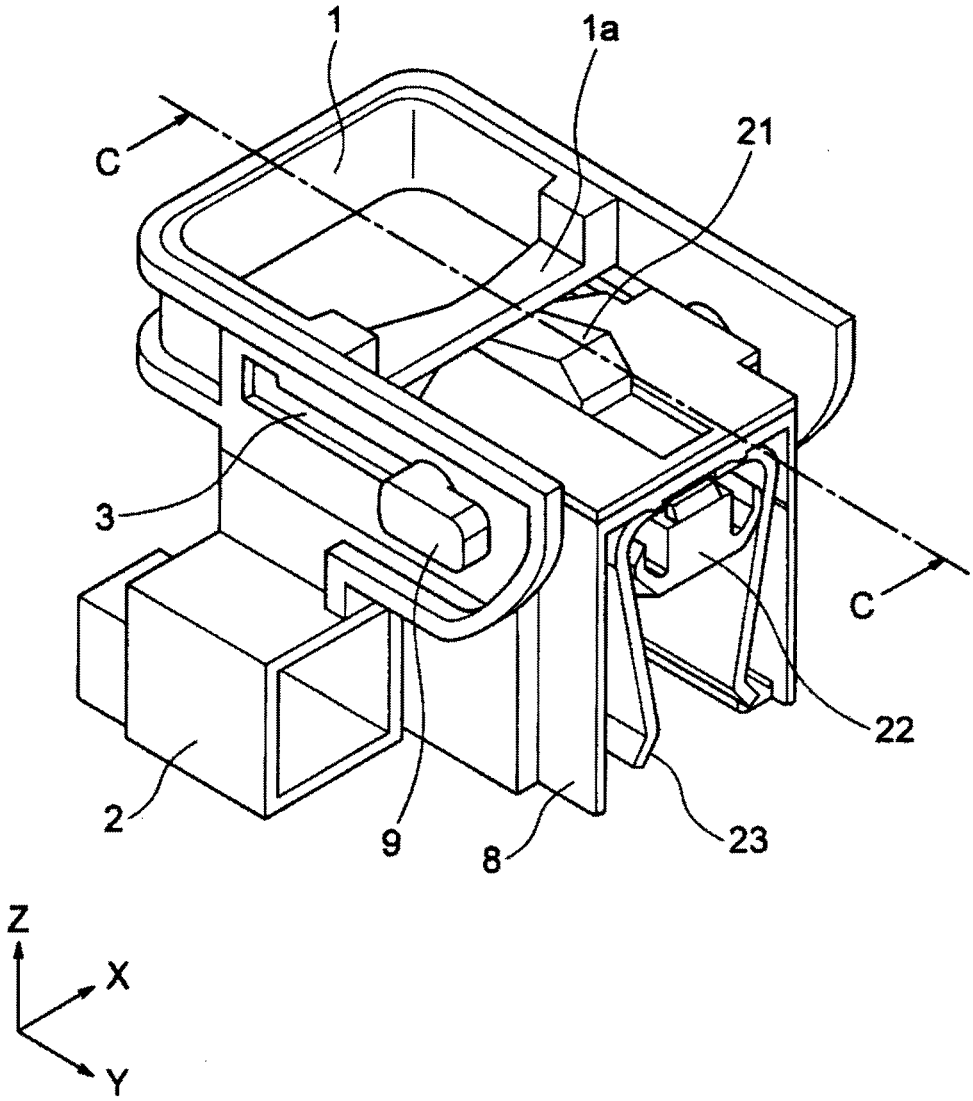
FIG. 14 is a side view for depicting the schematic configuration of the lever fitting-type connector in the lever fitting-type power circuit cutoff device of the second embodiment of the present invention.
Figure 15A:
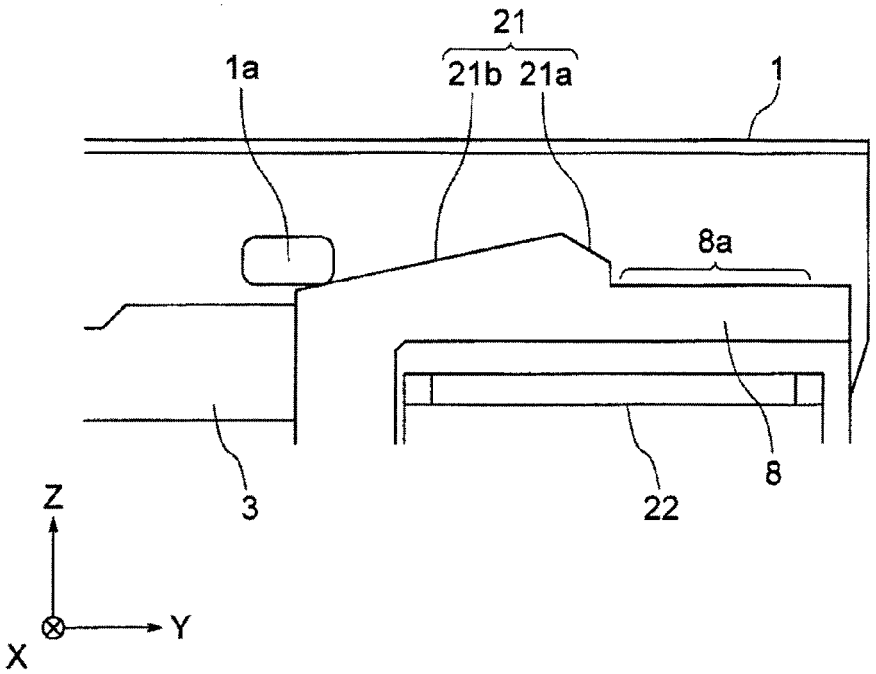
FIG. 15(*a*) is a sectional view taken along line C-C in FIG. 14, and FIG. 15(*b*) is a view for depicting a detailed configuration of a triangular protrusion illustrated in FIG. 15(*a*).
Figure 15B:
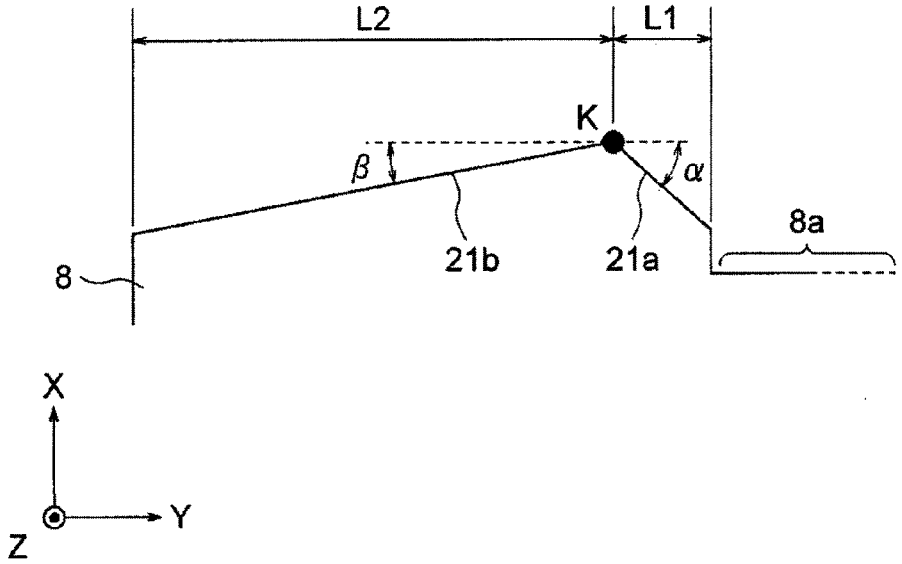
Figure 16:
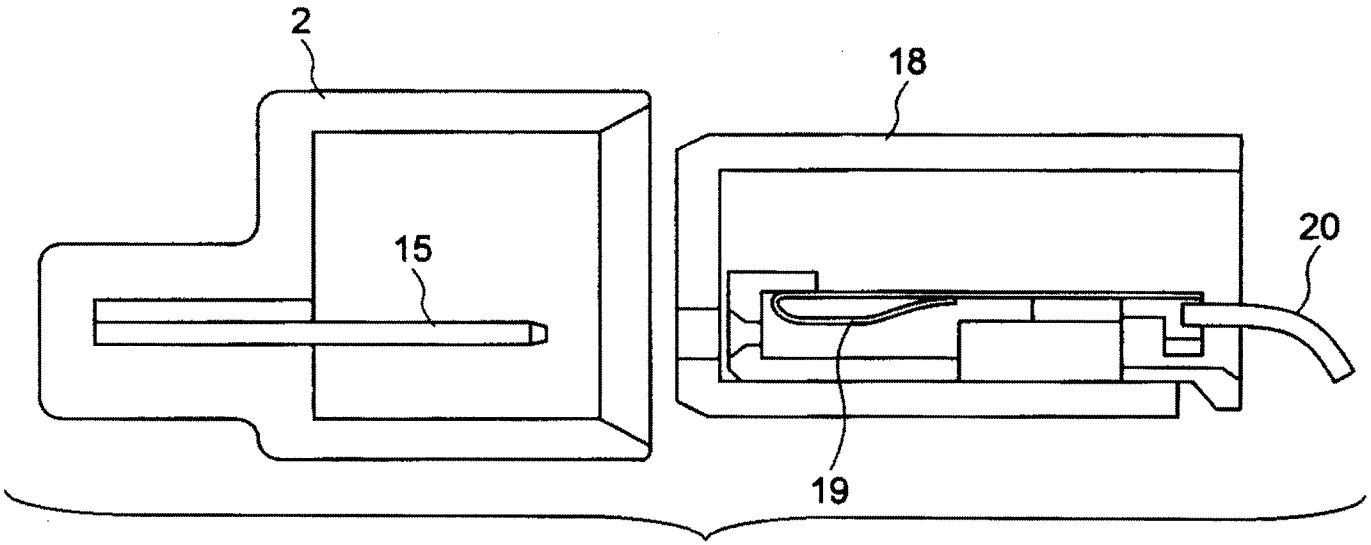
FIG. 16 is a view for depicting a positional relationship between a fitting-detecting female connector included in a vehicle-side connector and a lever cylinder of the lever fitting-type connector in the lever fitting-type power circuit cutoff device of the second embodiment of the present invention.
Figure 17:
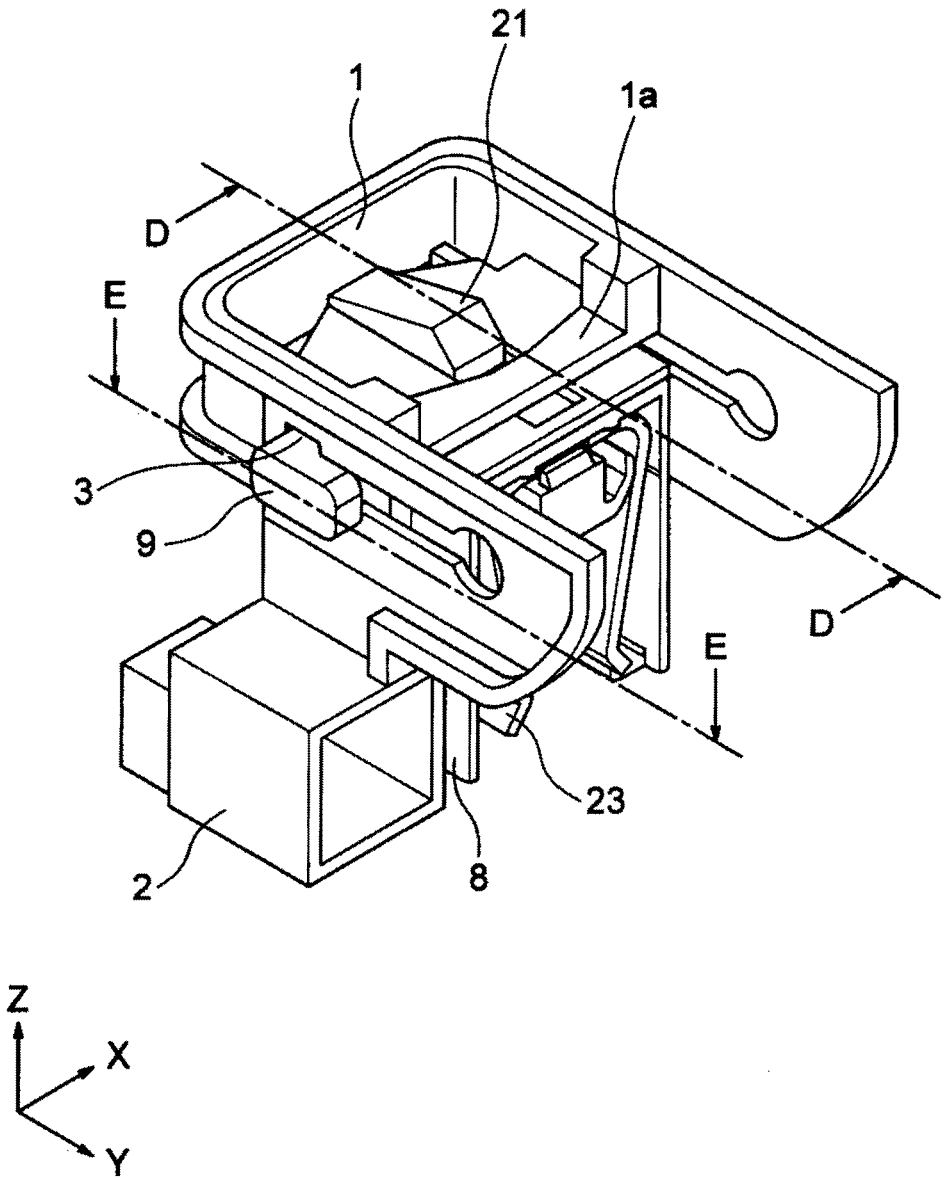
FIG. 17 is a side view for depicting the schematic configuration of the lever fitting-type connector in the lever fitting-type power circuit cutoff device of the second embodiment of the present invention.
Figure 18A:
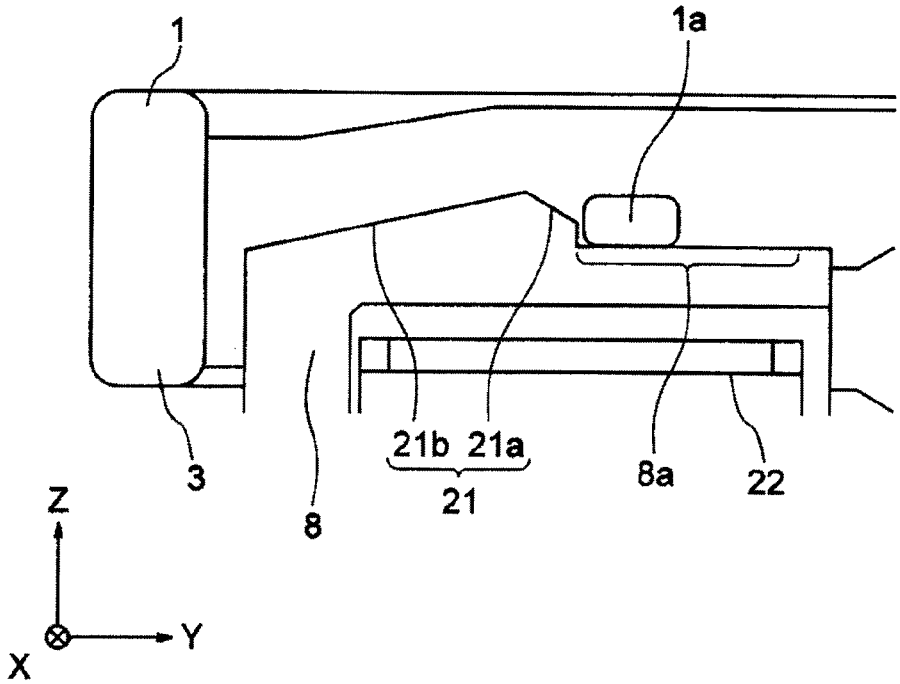
FIG. 18(*a*) is an enlarged sectional view taken along line D-D in FIG. 17, and FIG. 18(*b*) is a view for depicting a positional relationship between the lever cylinder and the fitting-detecting female connector.
Figure 18B:
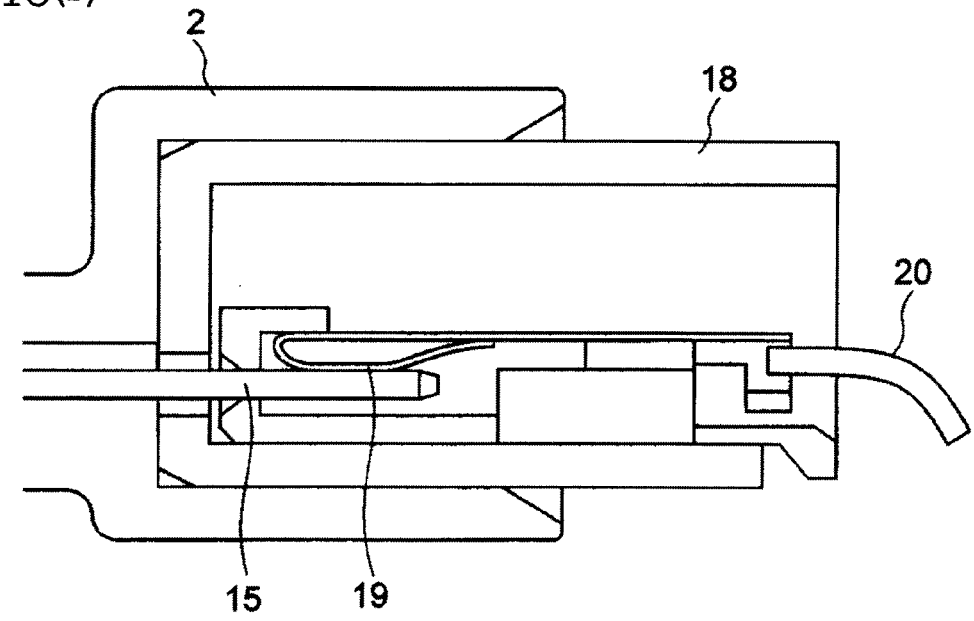
Figure 19:
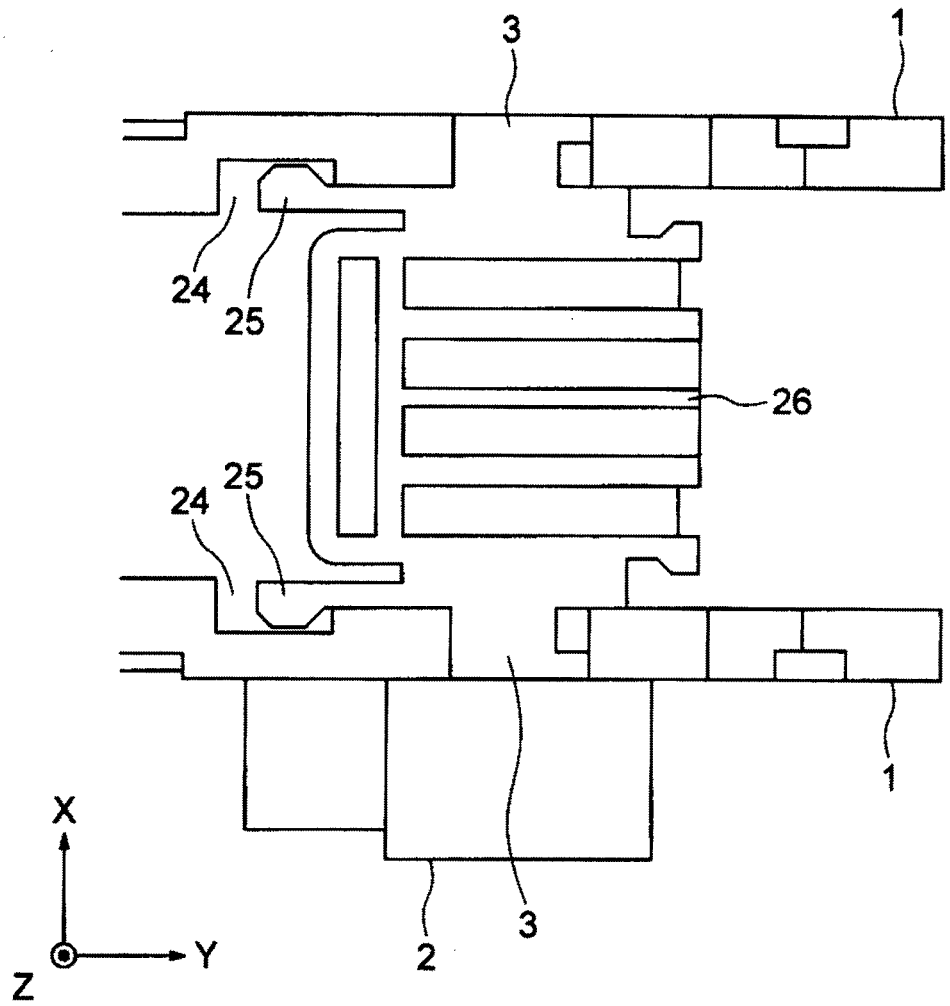
FIG. 19 is a sectional view taken along line E-E in FIG. 17.

FIGS. 14 and 17 are side views for depicting the schematic configuration of the lever fitting-type connector in the lever fitting-type power circuit cutoff device of the second embodiment of the present invention. FIG. 15 illustrates sectional views taken along line C-C in FIG. 14. FIG. 16 is a view for depicting a positional relationship between a fitting-detecting female connector included in a vehicle-side connector and a lever cylinder of the lever fitting-type connector in the lever fitting-type power circuit cutoff device of the second embodiment of the present invention. FIG. 18 illustrates an enlarged sectional view taken along line D-D in FIG. 17 and a view for depicting a positional relationship between the lever cylinder and the fitting-detecting female connector. FIG. 19 is a sectional view taken along line E-E in FIG. 17. Here, FIG. 15(*a*) is an enlarged sectional view taken along line C-C in FIG. 14, and FIG. 15(*b*) is a view for depicting a detailed configuration of the triangular protrusion 21 illustrated in FIG. 15(*a*). FIG. 18(*a*) is an enlarged sectional view taken along line D-D in FIG. 17, and FIG. 18(*b*) is a view for depicting a positional relationship between the lever cylinder and the fitting-detecting female connector.

Hereinafter, motion of the lever 1 during the sliding in the lever fitting-type connector of the second embodiment will be described with reference to FIGS. 14 to 19. Here, in the following description, similarly to the first embodiment, the vehicle-side connector, which the lever fitting-type connector of the second embodiment is inserted into and removed from in the upright state, is omitted for concise description. Only FIGS. 16 and 18 illustrate the fitting-detecting female connector 18 and the female electrode 19 disposed in the female connector 18 which are included in the vehicle-side connector.

As illustrated in FIG. 14, after the lever fitting-type connector of the second embodiment is inserted in the vehicle-side connector, the guide pins 9 are positioned in the rotation holes 3*a*, at the position (sliding start position) of the lever immediately after the lever 1 is rotated from the upright position to the prone position, similarly to the lever fitting-type connector in the related art. Here, as illustrated in FIG. 16, the lever cylinder 2 of the lever fitting-type connector is separated from the fitting-detecting female connector 18 included in the vehicle-side connector (not illustrated). Accordingly, since the signal terminal 15 disposed in the lever cylinder 2 is separated from the female electrode 19 disposed in the fitting-detecting female connector 18, the attachment of the lever fitting-type connector is not notified (detected), that is, non-attachment of the lever fitting-type connector is notified (detected).

Here, as is clear from FIG. 15(*a*), in the configuration of the triangular protrusion 21 formed in the top surface of the plug housing 8 of the second embodiment, the lever beam 1*a* is caused to come into contact with the top surface of the triangular protrusion 21 in accordance with the sliding operation of the lever 1 in the Y direction (right direction in FIG. 15(*a*)) and to slide in the top surface of the triangular protrusion 21 in the Y direction.

Particularly, as illustrated in FIG. 15(*b*), the triangular protrusion 21 of the second embodiment is formed to have a triangularly protruding shape formed of two inclined surfaces (first inclined surface 21*a* and second inclined surface 21*b*) having different inclined angles from each other, which are inclined in the sliding direction (rightward direction in FIG. 15(*b*) and Y direction) of the lever 1 from the edge of the plug housing 8. The second inclined surface 21*b* as one inclined surface is an inclined surface that gradually ascends in a straight line from the edge and reaches the apex portion (represented by a point K in FIG. 15(*b*)), and the first inclined surface 21*a* as the other inclined surface is an inclined surface that gradually descends in a straight line from the apex portion of the second inclined surface 21*b* and reaches a flat portion 8*a* in the top surface of the plug housing 8. Additionally, in the configuration of the second embodiment, a wall surface orthogonal to the flat portion 8*a* is provided at the end of the second inclined surface 21*b* on the lower side, thereby preventing the lever 1 from easily returning in the −Y direction. However, a configuration may be employed, in which the wall surface orthogonal to the flat portion 8*a* is not provided.

In addition, the triangular protrusion 21 employs a configuration in which an inclination of the second inclined surface 21*b* is more gradual than that of the first inclined surface 21*a*, and, in a case where the inclined angle of the first inclined surface 21*a* is $\alpha$ and the inclined angle of the second inclined surface 21*b* is $\beta$ with respect to an in-plane direction of the top surface of the plug housing 8, which is depicted by a dotted line in FIG. 15(*b*), the inclined angle $\beta$ of the second inclined surface 21*b* is smaller than the inclined angle $\alpha$ of the first inclined surface 21*a*. Hence, the triangular protrusion 21 of the second embodiment employs a configuration in which the second inclined surface 21*b* is longer than the first inclined surface 21*a* in length, and a distance L2 from the apex portion K of the second inclined surface 21*b* to the edge of the plug housing 8 is greater (longer) than a distance L1 from the apex portion K of the first inclined surface 21*a* to a termination of the first inclined surface 21*a*. As a result, in the lever fitting-type connector of the second embodiment, it is possible to decrease a force (reaction force) produced on the triangular protrusion 21 when the lever 1 is caused to slide in the horizontal direction (Y direction), that is, produced in a direction (−Y direction) opposite to the sliding direction. In other words, in the lever fitting-type connector of the second embodiment, it is possible to lower the peak of a pressing force (pressing force received by an operator from the lever 1) produced when the lever 1 is caused to slide in the horizontal direction (Y direction).

As a result, as illustrated in FIG. 17, an operator can cause the lever 1 to easily slide to the locking position (fitting end position of the lever fitting-type connector, that is, sliding end position). Here, as illustrated in FIG. 18(*a*), since the lever beam 1*a* reaches the termination of the first inclined surface 21*a*, a surface of the lever beam 1*a* on the plug housing 8 side comes into contact with the flat portion 8*a* in the top surface of the plug housing 8.

As illustrated in FIG. 18(*b*), the sliding operation of the lever 1 to the locking position causes the fitting-detecting female connector 18 included in the vehicle-side connector (not illustrated) to be fitted in the lever cylinder 2 formed in the lever 1. Accordingly, the signal terminal 15 disposed in the lever cylinder 2 is fitted in and electrically connected to the female electrode 19 disposed in the fitting-detecting female connector 18, and the attachment of the lever fitting-type connector is notified (detected) to the main unit of the power circuit cutoff device through the signal line 20.

Here, in the lever fitting-type connector of the second embodiment, as illustrated in FIG. 19, the locking recessed portions 24 is formed in the facing inner wall surfaces of the lever 1 (a pair of inner wall surfaces of the lever 1 that are disposed to face the sidewall surfaces of the plug housing 8), respectively, similarly to the lever fitting-type connector in the related art. Hence, as illustrated in FIG. 17, the protruding portion 25 formed at the end of an elastic member 26 is configured to engage with the recessed portion 24 at the locking position at which the guide pin 9 is positioned at the end of the guide groove 3. Additionally, the protruding portions 25 disposed on the corners of the ceiling wall of the plug housing 8 engage with the guide grooves 3 at a non-fitting position (position at which the guide pin 9 is disposed in the portion of the rotation hole 3*a*) taken immediately after the lever 1 is caused to pivot from the upright position to the prone position.

Additionally, the triangular protrusion 21 of the second embodiment employs the configuration in which an operation end position taken when the lever 1 is caused to slide, that is, the fitting end position of the lever fitting-type connector is matched with a termination position of the first inclined surface 21*a*; however, the configuration is not limited thereto. However, in the state in which the signal terminal 15 disposed in the lever cylinder 2 is inserted in the female electrode 19 disposed in the fitting-detecting female connector 18, in order to prevent the signal terminal 15 and the female electrode 19 from sliding due to the vibration or the like of a vehicle body, it is suitable to employ a configuration in which the fitting end position of the lever fitting-type connector is matched with the termination position of the first inclined surface 21*a*.

Figure 20:
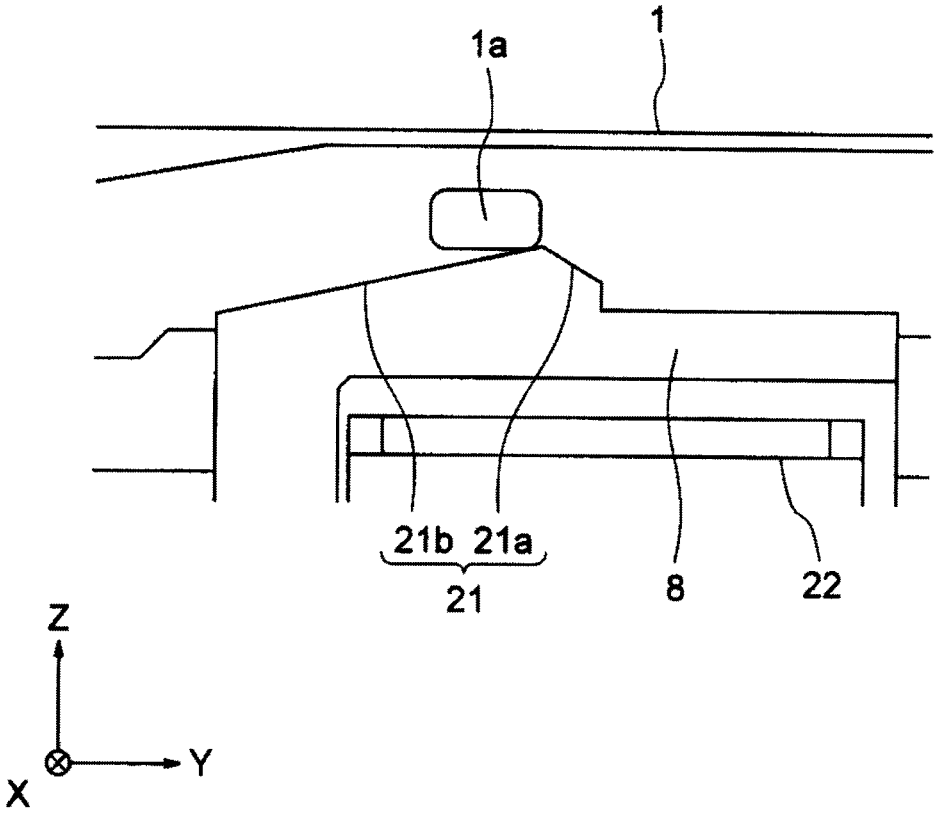
FIG. 20 is an enlarged sectional view of the triangular protrusion in a case where a lever beam does not run over the apex portion of the triangular protrusion in the second embodiment of the present invention.
Figure 21A:
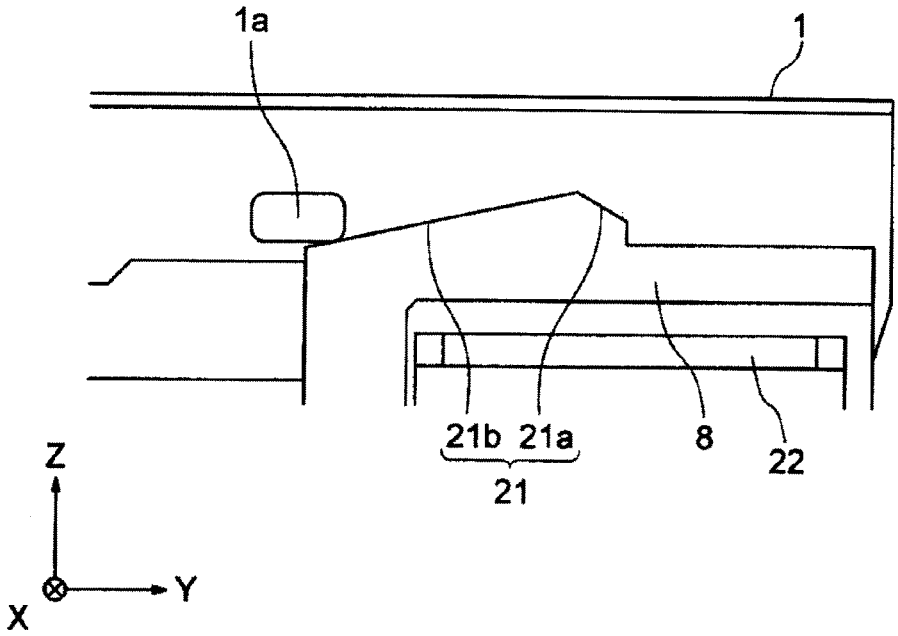
FIG. 21(*a*) is an enlarged sectional view of the triangular protrusion in a state in which the lever beam, which does not run over the apex portion of the triangular protrusion in the second embodiment of the present invention, is returned, and FIG. 21(*b*) is a view for depicting a positional relationship between the lever cylinder and the fitting-detecting female connector.
Figure 21B:
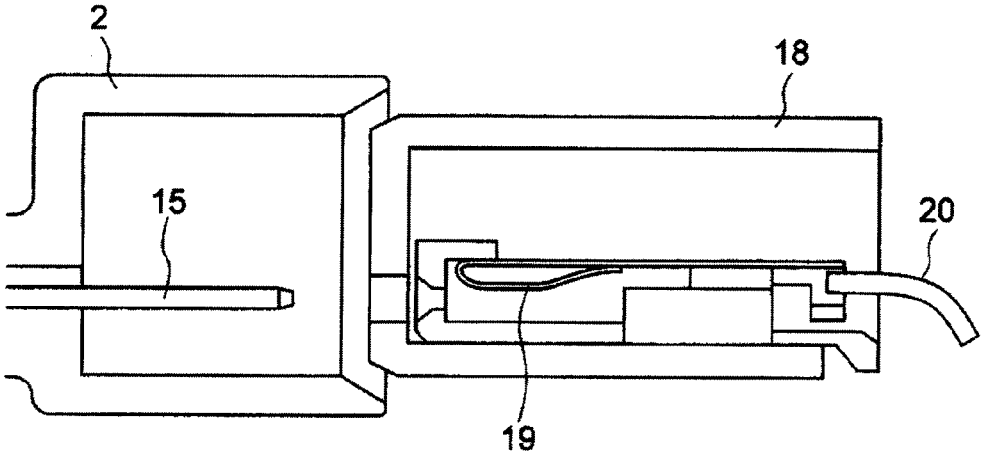

Next, FIG. 20 is an enlarged sectional view of the triangular protrusion in a case where the lever beam does not run over the apex portion of the triangular protrusion of the second embodiment of the present invention. FIG. 21(*a*) is an enlarged sectional view of the triangular protrusion in a case where the lever beam, which does not run over the apex portion of the triangular protrusion of the second embodiment of the present invention, is returned. Hereinafter, the preventing configuration of the midway insertion state in the second embodiment will be described in detail with reference to FIGS. 20 and 21. FIGS. 20 and 21(*a*) correspond to FIGS. 15(*a*) and 18(*a*).

As illustrated in FIG. 20, in a case where the lever beam 1*a* does not reach the apex portion K of the triangular protrusion 21, that is, in a case where the sliding operation of the lever 1 is stopped in the region in which the lever beam 1*a* comes into contact with the second inclined surface 21*b* of the triangular protrusion 21, the lever 1 is pressed in the −Z direction due to a force by which the guide pin 9 formed to have the same width as the width of the guide groove 3 causes the lever 1 to return to the prone state, that is, a force by which the lever 1 is caused to return to the side of the ceiling wall of the plug housing 8.

Hence, since a force in the −Y direction depending on the inclined angle β of the second inclined surface 21*b* is applied to the lever 1 and the lever beam 1*a*, as illustrated in FIG. 21(*a*), the lever 1 slides such that the lever beam 1*a* moves to the lower side (end side of the plug housing 8) of the second inclined surface 21*b*.

As a result, as illustrated in FIG. 21(*b*), the signal terminal 15 disposed in the lever cylinder 2 is positioned to be separated from the female electrode 19 disposed in the fitting-detecting female connector 18. Accordingly, the sliding operation of the lever 1 is stopped in the region in which the lever beam 1*a* comes into contact with the second inclined surface 21*b* of the triangular protrusion 21, it is also possible to obtain a remarkable effect that it is possible to prevent erroneous detection of the electrical connection of the signal terminal 15 with the female electrode 19, similarly to the first embodiment.

Figure 26:
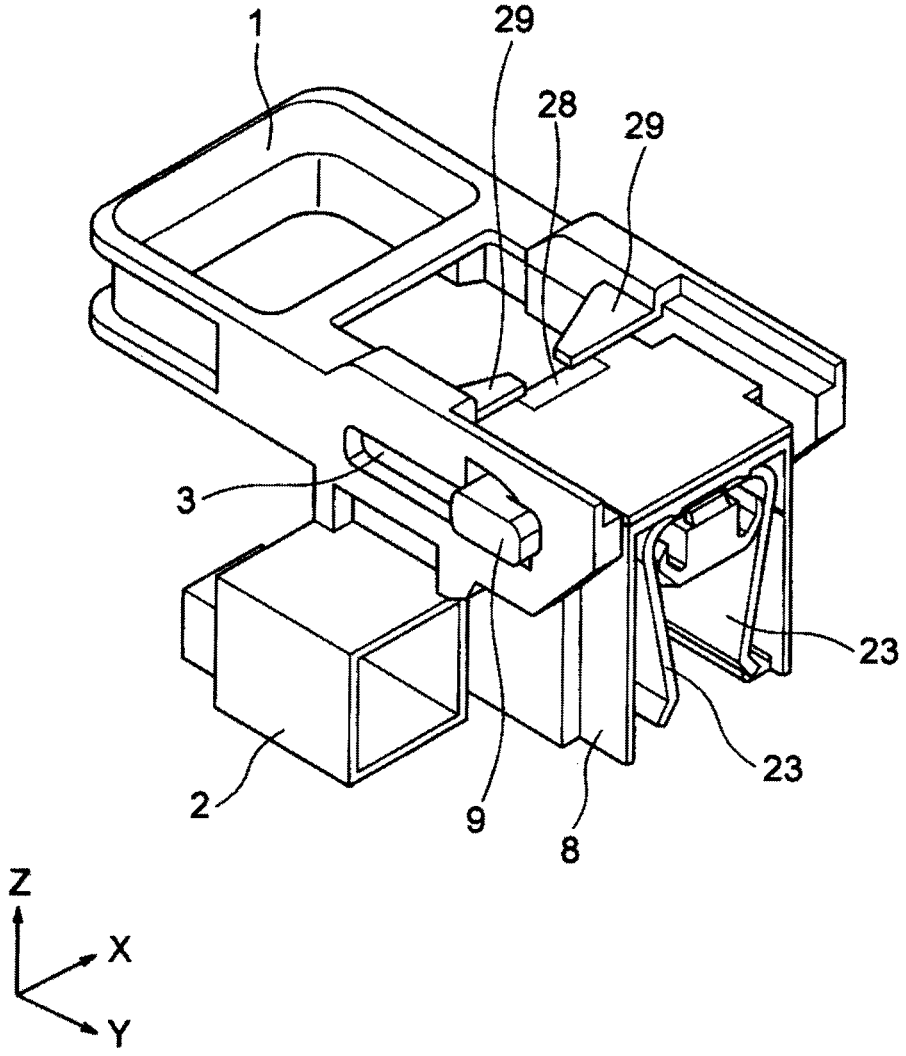
FIG. 26 is a perspective view for depicting a schematic configuration of another lever fitting-type connector in the related art.

Particularly, in the lever fitting-type connector in the related art, as illustrated in FIG. 26, there is a lever fitting-type connector employing a configuration in which a protrusion-like body 28 extending to the edge of the outer wall surface of the ceiling wall of the plug housing 8 in the X direction is provided to protrude and a pair of protrusion-like bodies 29 are also formed in the lever 1.

However, in the configuration of the lever fitting-type connector in the related art, in the prone state entered immediately after the pivot movement of the lever 1, that is, in a state in which the lever 1 illustrated in FIG. 26 is positioned at the sliding start position, the protruding portions 25 illustrated in FIG. 19 engage with the guide grooves 3. Thus, when the lever 1 is caused to slide, the first sense of operational click is felt when the protrusion-like body 29 formed in the lever 1 runs over the protrusion-like body 28 formed in the plug housing 8. Further, when the lever 1 is caused to slide and reaches the locking position, as illustrated in FIG. 19, the protruding portion 25 engages with the recessed portion 24, and thereby the second sense of operational click is felt.

Figure 22:
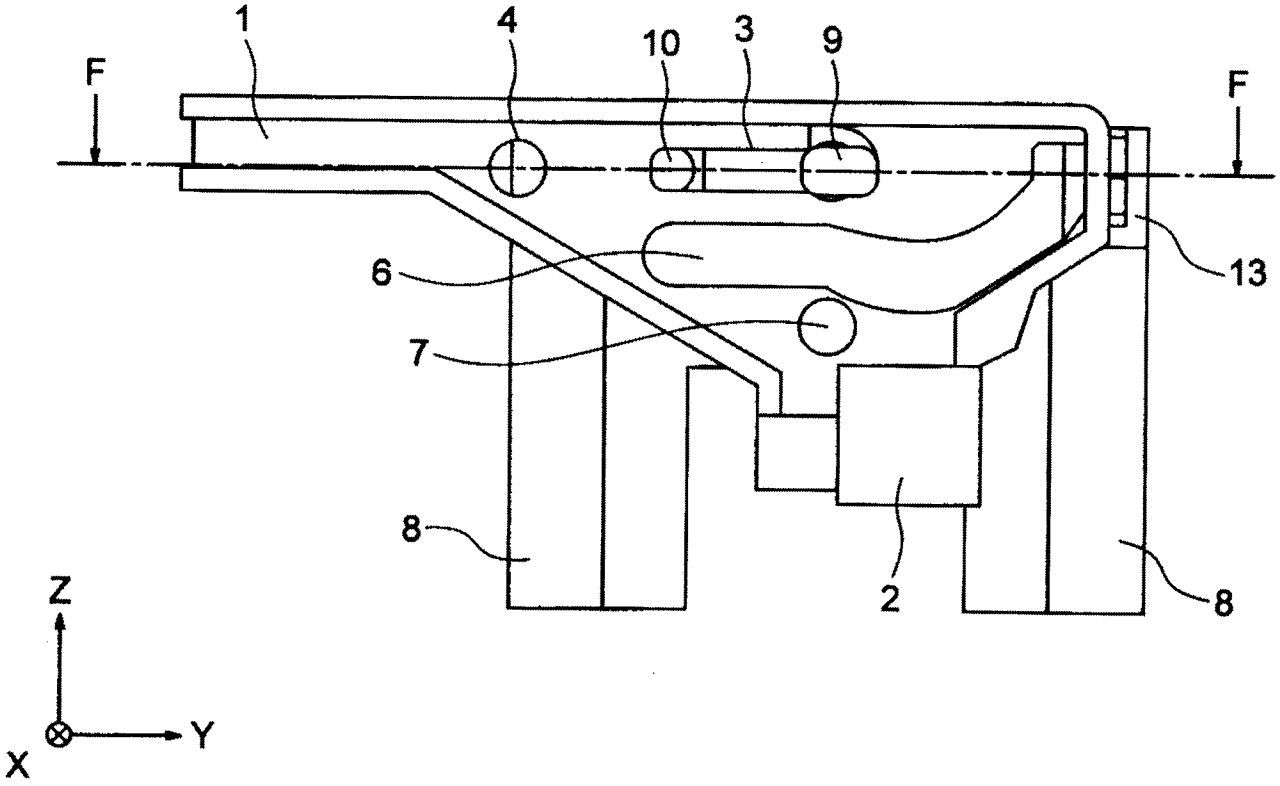
FIG. 22 is a side view for depicting a schematic configuration of a lever fitting-type connector in the related art.
Figure 23:
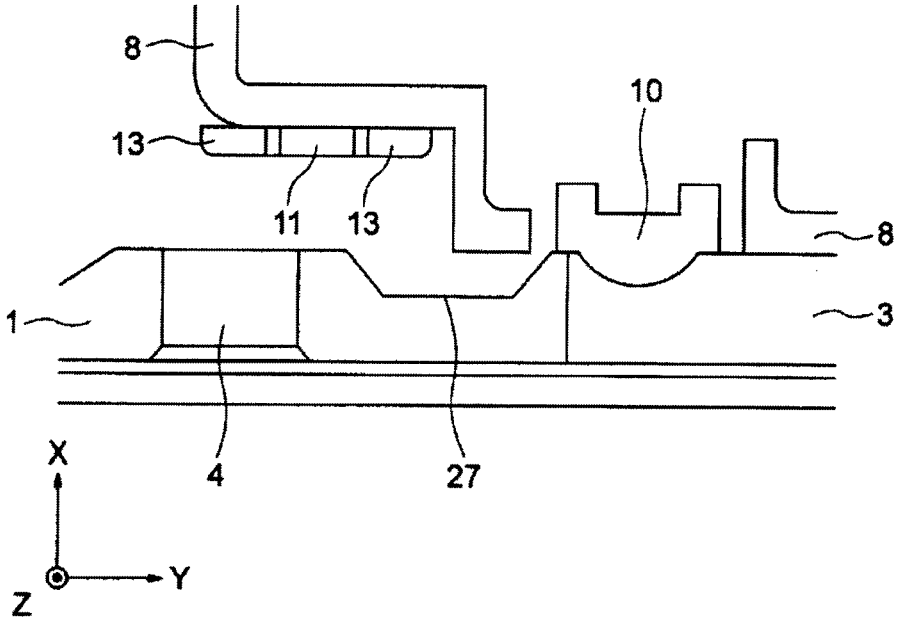
FIG. 23(*a*) is an enlarged sectional view taken along line F-F in FIG. 22, and FIG. 23(*b*) is a view for depicting a positional relationship between a lever cylinder and a fitting-detecting female connector.
Figure 23:
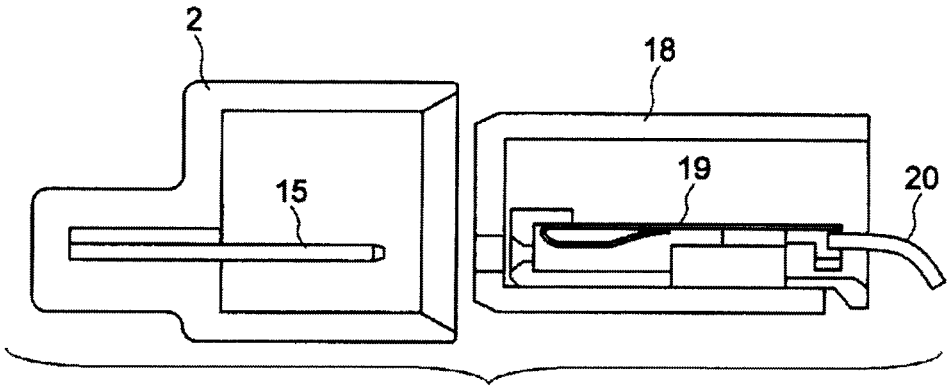
Figure 24:
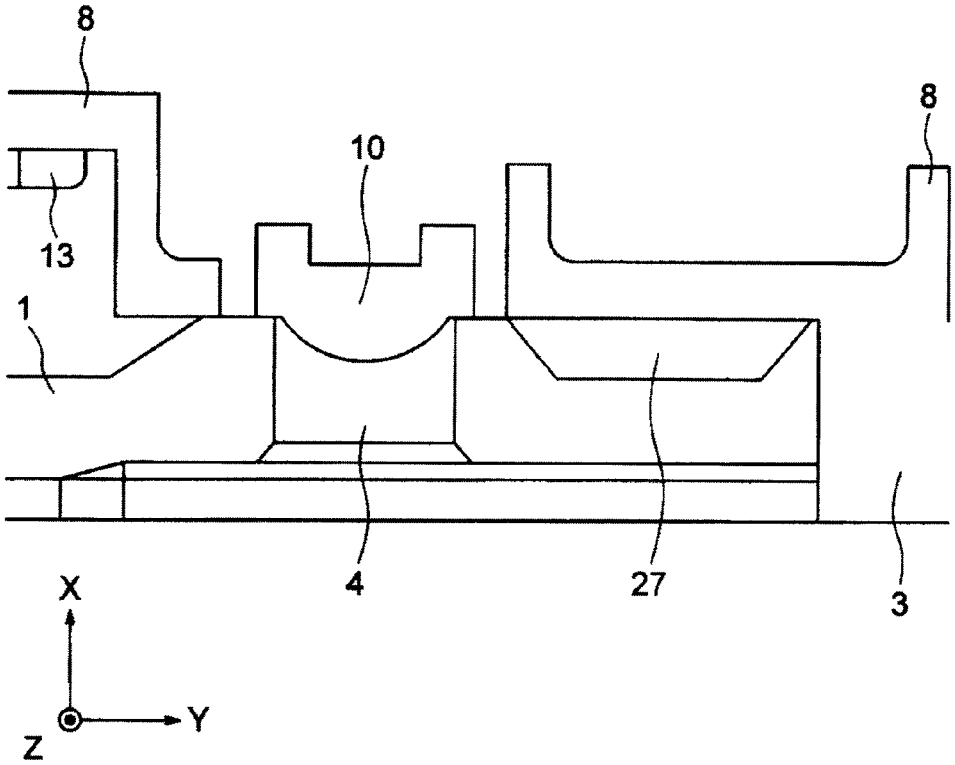
FIG. 24(*a*) is an enlarged sectional view corresponding to line F-F in FIG. 22 when sliding of a lever is ended, and FIG. 24(*b*) is a view for depicting a positional relationship between the lever cylinder and the fitting-detecting female connector.
Figure 24:
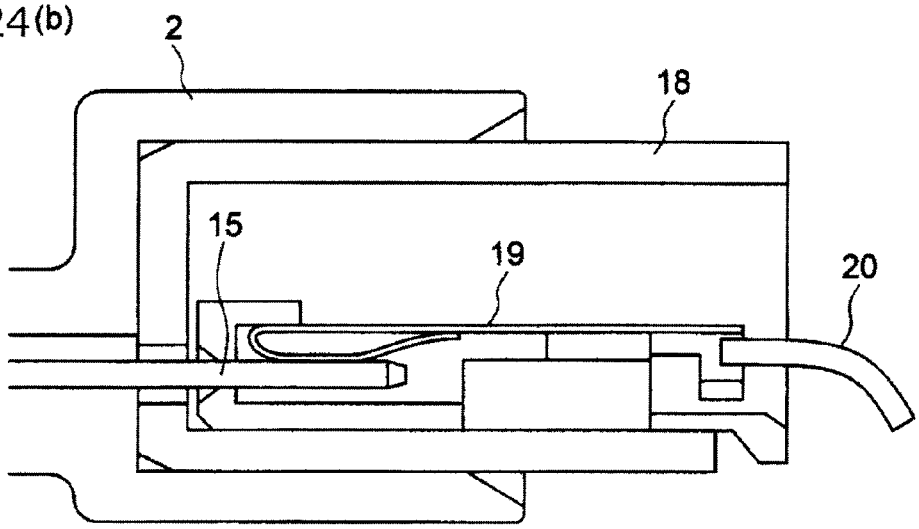
Figure 25A:
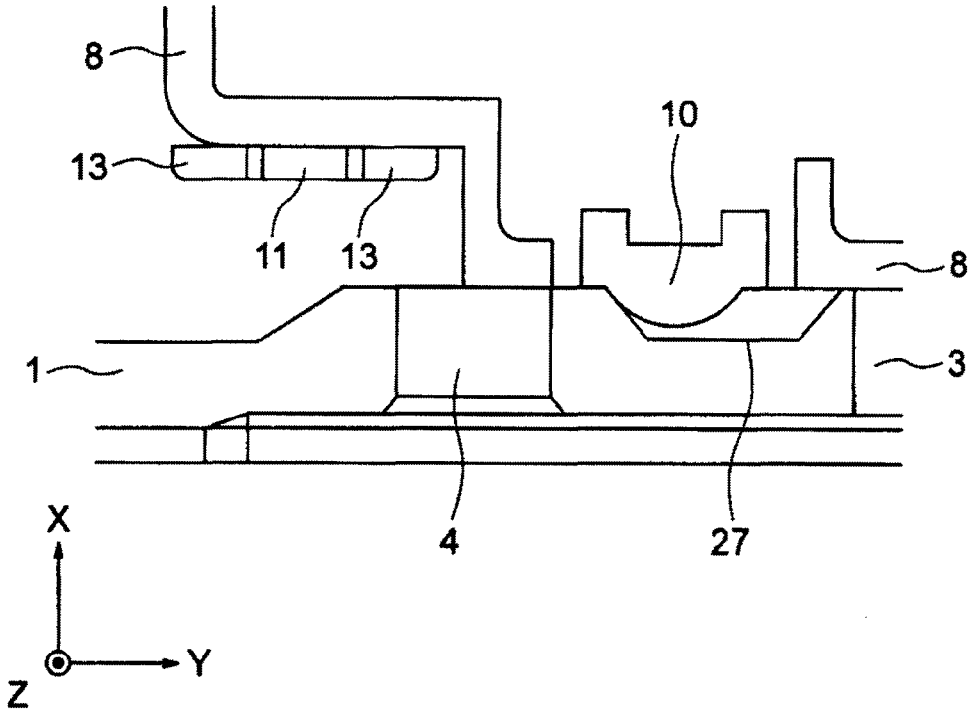
FIG. 25(*a*) is an enlarged sectional view corresponding to line F-F in FIG. 22 when sliding of a lever is performed to a midway position, and FIG. 25(*b*) is a view for depicting a positional relationship between the lever cylinder and the fitting-detecting female connector.
Figure 25B:
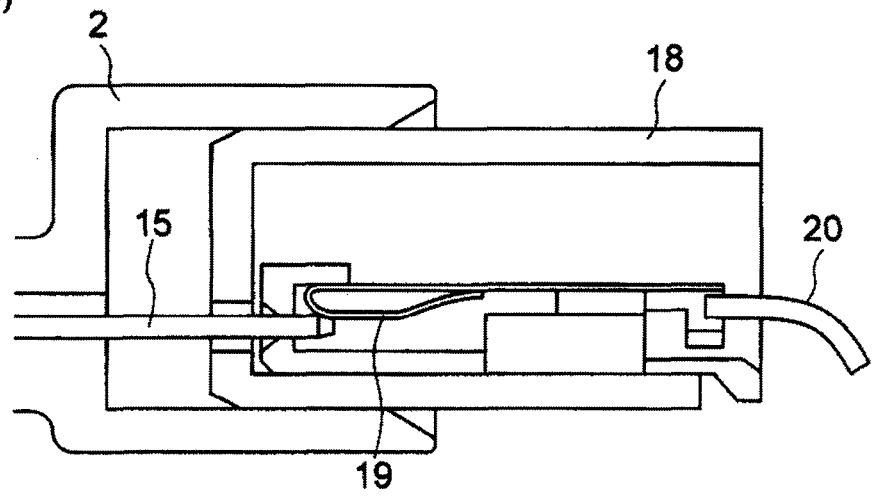

Thus, similarly to the lever fitting-type connector in the related art illustrated in FIG. 22, in the lever fitting-type connector in the related art illustrated in FIG. 26, there is a concern that an unskilled operator will mistake the first sense of operational click as the sense of operational click felt when the protruding portion 25 engages with the recessed portion 24, and the operator will stop the sliding operation of the lever 1 at midway position. Therefore, the above-described effect that it is possible to prevent erroneous detection of the electrical connection of the signal terminal 15 with the female electrode 19 performed due to the midway insertion is also significantly important in the lever fitting-type connector employing the configuration of the second embodiment.

Here, the characteristics of the embodiments of the lever fitting-type connector according to the present invention are concisely summarized and listed in the following [1] to [6].

[1] A lever fitting-type connector of a power circuit cutoff device that is provided with a plug housing (8) which has a pair of guide pins (9) provided to project outward from outer wall surfaces of facing sidewalls, respectively, and a lever (1) which has guide grooves (3), into which the guide pins are inserted, in the facing sidewalls, and which straddles the plug housing so as to be pivotably and slidably supported with respect to the plug housing, and that is fitted in and separated from a vehicle connector disposed on a vehicle side so as to perform supplying of and cutting off of power from a power supply, the lever fitting-type connector includes: a contact member (hemispherical protrusion 10) which is formed in one wall surface of an inner wall surface of a sidewall of the lever with the guide groove formed, and an outer wall surface of the plug housing with the guide pin formed; and a triangular recess (5) with which the contact member comes into contact during sliding of the lever, and which is formed in a region from a sliding start position of the lever to a sliding end position of the lever, in the inner wall surface of the lever or the outer wall surface of the plug housing, in which the contact member is not formed. The triangular recess includes a first inclined surface (5*a*) that extends in a direction from the sliding start position toward the sliding end position of the lever and that is inclined in a projecting direction of the contact member, and a second inclined surface (5*b*) that extends in a direction from the edge of the first inclined surface on the sliding end position side toward the sliding end position and that is inclined in a direction opposite to the projecting direction of the contact member. With a sliding direction of the lever as a reference, an inclined angle of the second inclined surface is smaller than an inclined angle of the first inclined surface.

[2] The lever fitting-type connector according to [1] above, includes: a first terminal (signal terminal 15) that is attached to a first fitting portion (lever cylinder 2) formed in a side portion of the lever; and a second terminal (female electrode 19) that is attached to a second fitting portion (female connector 18) formed in the vehicle connector. The first fitting portion and the second fitting portion are fitted at the sliding end position of the lever and the first terminal and the second terminal are electrically connected. In a case where the contact member comes into contact with a position at which an end of the first inclined surface intersects with an end of the second inclined surface, at least the first terminal and the second terminal are separated from each other.

[3] In the lever fitting-type connector according to [1] or [2] above, the contact member is formed in the outer wall surface of the plug housing, and the triangular recess is formed in the inner wall surface of the lever.

[4] A lever fitting-type connector of a power circuit cutoff device that is provided with a plug housing (8) which has a pair of guide pins (9) provided to project outward from outer wall surfaces of facing sidewalls, respectively, and a lever (1) which has guide grooves (3), into which the guide pins are inserted, in the facing sidewalls, and which is pivotably and slidably supported with respect to the plug housing so as to straddle the plug housing and that is fitted in and separated from a vehicle connector disposed on a vehicle side so as to perform supplying of and cutting off of power from a power supply, the lever fitting-type connector includes: a contact member (lever beam 1*a*) which is formed in one of the lever with the guide groove formed, and an outer wall surface of a ceiling wall of the plug housing with the guide pin formed; and a triangular protrusion (21) with which the contact member comes into contact during sliding of the lever, and which is formed in a region from a sliding start position of the lever to a sliding end position of the lever, in the lever or the outer wall surface of the plug housing, in which the contact member is not formed. The triangular recess includes a first inclined surface (21*a*) that extends in a direction from the sliding end position toward the sliding start position of the lever and that is inclined toward the contact member side, and a second inclined surface (21*b*) that extends from the edge of the first inclined surface on the sliding start position side of the lever to the end region of the plug housing which is the sliding start position of the lever and that is inclined toward a side opposite to the contact member side. With a sliding direction of the lever as a reference, an inclined angle of the second inclined surface is smaller than an inclined angle of the first inclined surface.

[5] The lever fitting-type connector according to [4] above, further includes: a first terminal (signal terminal 15) that is attached to a first fitting portion (lever cylinder 2) formed in a side portion of the lever; and a second terminal (female electrode 19) that is attached to a second fitting portion (female connector 18) formed in the vehicle connector. The first fitting portion and the second fitting portion are fitted at the sliding end position of the lever and the first terminal and the second terminal are electrically connected. In a case where the contact member comes into contact with the end region of the plug housing which is the sliding start position of the lever, at least the first terminal and the second terminal are separated from each other.

[6] In the lever fitting-type connector according to [4] or [5] above, the contact member is formed in the lever, and the triangular protrusion is formed in the ceiling wall of the plug housing.

The present invention is described in detail and with reference specific embodiments; however, it is obvious for those skilled in the art that it is possible to perform various alterations or modifications without departing a spirit and a range of the present invention.

According to the present invention, the following effect is achieved. It is possible to lower the peak of an operational force in the second half of a sliding operation during the sliding operation of the lever is achieved. The present invention that achieves the effect is applicable to a lever fitting-type connector.

What is claimed is:

1. A lever fitting-type connector of a power circuit cutoff device performing supplying of and cutting off of power from a power supply with the lever fitting-type connector fitted in and separated from a vehicle connector disposed on a vehicle side, the lever fitting-type connector comprising:

a plug housing that has a pair of guide pins provided to project outward from outer wall surfaces of facing sidewalls, respectively;

a lever that has guide grooves, into which the guide pins are inserted, in facing sidewalls, and that straddles the plug housing so as to be pivotably and slidably supported with respect to the plug housing;

a contact member that is formed in one wall surface of an inner wall surface of a sidewall of the lever with the guide groove formed, and an outer wall surface of the plug housing with the guide pin formed; and a triangular recess with which the contact member comes into contact during sliding of the lever, and which is formed in a region from a sliding start position of the lever to a sliding end position of the lever, in the inner wall surface of the lever or the outer wall surface of the plug housing, in which the contact member is not formed, wherein the triangular recess includes a first inclined surface that extends in a direction from the sliding start position toward the sliding end position of the lever and that is inclined in a projecting direction of the contact member, and a second inclined surface that extends in a direction from an edge of the first inclined surface on the sliding end position side toward the sliding end position and that is inclined in a direction opposite to the projecting direction of the contact member, and wherein, with a sliding direction of the lever as a reference, an inclined angle of the second inclined surface is smaller than an inclined angle of the first inclined surface.

2. The lever fitting-type connector according to claim 1, comprising:

a first terminal that is attached to a first fitting portion formed in a side portion of the lever; and a second terminal that is attached to a second fitting portion formed in the vehicle connector, wherein the first fitting portion and the second fitting portion are fitted at the sliding end position of the lever and the first terminal and the second terminal are electrically connected, and wherein, in a case where the contact member comes into contact with a position at which an end of the first inclined surface intersects with an end of the second inclined surface, at least the first terminal and the second terminal are separated from each other.

3. The lever fitting-type connector according to claim 1, wherein the contact member is formed in the outer wall surface of the plug housing, and wherein the triangular recess is formed in the inner wall surface of the lever.

4. A lever fitting-type connector of a power circuit cutoff device performing supplying of and cutting off of power from a power supply with the lever fitting-type connector fitted in and separated from a vehicle connector disposed on a vehicle side, the lever fitting-type connector comprising:

a plug housing that has a pair of guide pins provided to project outward from outer wall surfaces of facing sidewalls, respectively;

a lever that has guide grooves, into which the guide pins are inserted, in facing sidewalls, and that straddles the plug housing so as to be pivotably and slidably supported with respect to the plug housing;

a contact member that is formed in one of the lever with the guide groove formed, and an outer wall surface of a ceiling wall of the plug housing with the guide pin formed; and a triangular protrusion with which the contact member comes into contact during sliding of the lever, and which is formed in a region from a sliding start position of the lever to a sliding end position of the lever, in the lever or the outer wall surface of the plug housing, in which the contact member is not formed, wherein the triangular protrusion includes a first inclined surface that extends in a direction from the sliding end position toward the sliding start position of the lever and that is inclined toward the contact member side, and a second inclined surface that extends from an edge of the first inclined surface on the sliding start position side of the lever to an end region of the plug housing which is the sliding start position of the lever and that is inclined toward a side opposite to the contact member side, and wherein, with a sliding direction of the lever as a reference, an inclined angle of the second inclined surface is smaller than an inclined angle of the first inclined surface.

5. The lever fitting-type connector according to claim 4, comprising:

a first terminal that is attached to a first fitting portion formed in a side portion of the lever; and a second terminal that is attached to a second fitting portion formed in the vehicle connector, wherein the second fitting portion is fitted in the first fitting portion at the sliding end position of the lever and the first terminal is electrically connected with the second terminal, and wherein, in a case where the contact member comes into contact with the end region of the plug housing which is the sliding start position of the lever, at least the first terminal and the second terminal are separated from each other.

6. The lever fitting-type connector according to claim 4, wherein the contact member is formed in the lever, and wherein the triangular protrusion is formed in the ceiling wall of the plug housing.

* * * * *